US010479099B2

(12) United States Patent
Kanbe et al.

(10) Patent No.: US 10,479,099 B2
(45) Date of Patent: Nov. 19, 2019

(54) SYSTEM FOR CONSUMING CONSUMABLE MATERIAL STORED IN CARTRIDGE

(71) Applicant: BROTHER KOGYO KABUSHIKI KAISHA, Nagoya-shi, Aichi-ken (JP)

(72) Inventors: Tomohiro Kanbe, Nagoya (JP); Naoya Okazaki, Gifu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/013,673

(22) Filed: Jun. 20, 2018

(65) Prior Publication Data

US 2018/0297366 A1 Oct. 18, 2018

Related U.S. Application Data

(63) Continuation of application No. PCT/JP2016/000471, filed on Jan. 29, 2016.

(51) Int. Cl.
*B41J 2/175* (2006.01)

(52) U.S. Cl.
CPC ..... *B41J 2/1753* (2013.01); *B41J 2/1752* (2013.01); *B41J 2/17513* (2013.01); *B41J 2/17546* (2013.01); *B41J 2/17553* (2013.01)

(58) Field of Classification Search
CPC .. B41J 2/1753; B41J 2/17513; B41J 2/17546; B41J 2/1752; B41J 2/17553
See application file for complete search history.

(56) References Cited

U.S. PATENT DOCUMENTS

| | | | | |
|---|---|---|---|---|
| 6,168,262 | B1 * | 1/2001 | Clark | B41J 2/1752 347/50 |
| 8,985,743 | B2 * | 3/2015 | Sasaki | B41J 2/1752 347/19 |
| 9,554,459 | B2 * | 1/2017 | Gruenbacher | A61L 9/14 |
| 9,802,419 | B2 * | 10/2017 | Okazaki | B41J 2/17543 |
| 2003/0051904 | A1 * | 3/2003 | Aruga | B41J 2/17509 174/255 |

(Continued)

FOREIGN PATENT DOCUMENTS

| | | |
|---|---|---|
| EP | 2 743 086 A2 | 6/2014 |
| JP | 2007-15369 A | 1/2007 |
| JP | 2011-173256 A | 9/2011 |

OTHER PUBLICATIONS

IP.com search (Year: 2019).*

(Continued)

*Primary Examiner* — Lisa Solomon
(74) *Attorney, Agent, or Firm* — Merchant & Gould P.C.

(57) ABSTRACT

A system includes a cartridge attachment section and a cartridge attachable to the cartridge attachment section. The cartridge includes a board supporting portion supporting a board provided with an electrical interface. The cartridge attachment section includes a slider having a first wall, a second wall and an electrical contact. During insertion of the cartridge, the slider is moved from a second posture where the electrical contact separates from the electrical interface into a first posture where the electrical contact contacts the electrical interface. Upon completion of attachment of the cartridge, the first wall and the second wall are received respectively in a first space and a second space defined between the cartridge and the cartridge attachment section.

11 Claims, 12 Drawing Sheets

(56) References Cited

U.S. PATENT DOCUMENTS

| | | | | |
|---|---|---|---|---|
| 2005/0151811 | A1* | 7/2005 | Shimizu | B41J 2/1752 347/86 |
| 2006/0290754 | A1 | 12/2006 | Nozawa et al. | |
| 2008/0122904 | A1 | 5/2008 | Tsai et al. | |
| 2011/0205284 | A1 | 8/2011 | Yoshino et al. | |
| 2013/0050359 | A1* | 2/2013 | Kanbe | B41J 2/175 347/86 |
| 2014/0085387 | A1* | 3/2014 | Kanbe | B41J 2/175 347/86 |
| 2014/0168324 | A1* | 6/2014 | Sasaki | B41J 2/17523 347/86 |
| 2017/0274378 | A1* | 9/2017 | Turner | B01L 3/502715 |

OTHER PUBLICATIONS

International Search Report and Written Opinion issued in related International application No. PCT/JP2016000471, dated Oct. 7, 2016.

International Preliminary Report on Patentability issued in related International Application No. PCT/JP2016/000471, dated Aug. 9, 2018.

* cited by examiner

SYSTEM FOR CONSUMING CONSUMABLE MATERIAL STORED IN CARTRIDGE

CROSS REFERENCE TO RELATED APPLICATION

This application is a continuation of International Application No. PCT/JP2016/000471 filed Jan. 29, 2016 in Japan Patent Office as a Receiving Office. The entire content of the International Application is incorporated herein by reference.

TECHNICAL FIELD

The present invention relates to a system that is configured to consume a consumable material stored in a cartridge attached to a cartridge attachment section.

BACKGROUND

Japanese Patent Application Publication No. 2011-173256 discloses a printer that includes a cartridge storing ink and a cartridge holder to which the cartridge is attached. The cartridge is provided with an electrode. The cartridge holder is provided with a pivot member having an electrical contact. In this printer, the cartridge being inserted into the cartridge holder causes the pivot member to pivot to move the electrical contact toward the cartridge. Upon completion of attachment of the cartridge, the electrode of the cartridge is in contact with the moved electrical contact. In this way, the printer can access an IC chip provided on the cartridge through the contact between the electrode and the electrical contact.

SUMMARY

As a circuit becomes highly integrated, a size of a circuit board becomes smaller and electrodes mounted on the smaller circuit board also become smaller in size. If the circuit board is not accurately positioned relative to a cartridge, the electrodes mounted on the circuit board may be unable to make contact with electrical contacts of a printer when the cartridge is mounted in the printer. If such cartridge with the inaccurately-positioned circuit board is mounted in the printer, the electrodes and the electrical contacts of the printer, which were in contact with each other immediately after the cartridge was mounted in the printer, could be separated from each other sometime later, due to, for example, vibrations of the printer.

In view of the foregoing, it is an object of the present disclosure to provide a system in which a reliable electrical contact can be achieved between an electrical interface of a cartridge and an electric contact of a cartridge attachment section.

In order to attain the above and other objects, according to an aspect of the disclosure, there is provided a system including a cartridge configured to store a consumable material, a cartridge attachment section, and a consuming section. The cartridge is inserted into and attached to the cartridge attachment section in a first direction, the cartridge being removed from the cartridge attachment section in a second direction opposite to the first direction. The consuming section is configured to consume the consumable material stored in the cartridge completely attached to the cartridge attachment section. The cartridge includes a board supporting portion, a board supported by the board supporting portion, and an electrical interface. The board has a mount surface and a supported surface opposite to the mount surface, the mount surface facing in a third direction perpendicular to the first direction and the second direction, the supported surface facing in a fourth direction opposite to the third direction and supported by the board supporting portion, the board and a portion of the board supporting portion defining a moving trajectory during insertion and removal of the cartridge relative to the cartridge attachment section. The electrical interface is mounted on the mount surface of the board. The cartridge attachment section includes: a slider; an electrical contact provided on the slider; a first wall provided on the slider at a position offset in the first direction relative to the electrical contact; a second wall provided on the slider at a position offset in the second direction relative to the electrical contact; and a biasing member configured to apply a biasing force to the slider in the second direction. The slider is configured to contact at least one of the board and the board supporting portion of the cartridge, the slider being movable between a first position and a second position and between a first posture and a second posture in accordance with insertion and removal of the cartridge relative to the cartridge attachment section, the second position being displaced in the third direction relative to the first position, the slider at the first position being in the first posture and the slider at the second position being in the second posture. The electrical contact is configured to contact the electrical interface of the cartridge, the electrical contact being movable between a contact position and a non-contact position in accordance with the movement of the slider between the first posture and the second posture. The first wall has a portion that overlaps the moving trajectory of the board and the portion of the board supporting portion during insertion and removal of the cartridge relative to the cartridge attachment section. When the slider is at the first position and in the first posture, the electrical contact is in the contact position and overlaps the electrical interface of the cartridge completely attached to the cartridge attachment section, the second wall having a portion overlapping the moving trajectory. When the slider is in the second posture, the electrical contact is in the non-contact position displaced in the third direction relative to the contact position, the second wall being displaced in the third direction relative to the moving trajectory. When the cartridge has been completely attached to the cartridge attachment section, the cartridge and the cartridge attachment section define a first space therebetween at a position offset in the first direction relative to the board and the portion of the board supporting portion, the first wall being accommodated in the first space; and the cartridge and the cartridge attachment section define a second space therebetween at a position offset in the second direction relative to the board and the portion of the board supporting portion, the second wall of the slider at the first position and in the first posture being accommodated in the second space.

DETAILED DESCRIPTION

Figure 1:
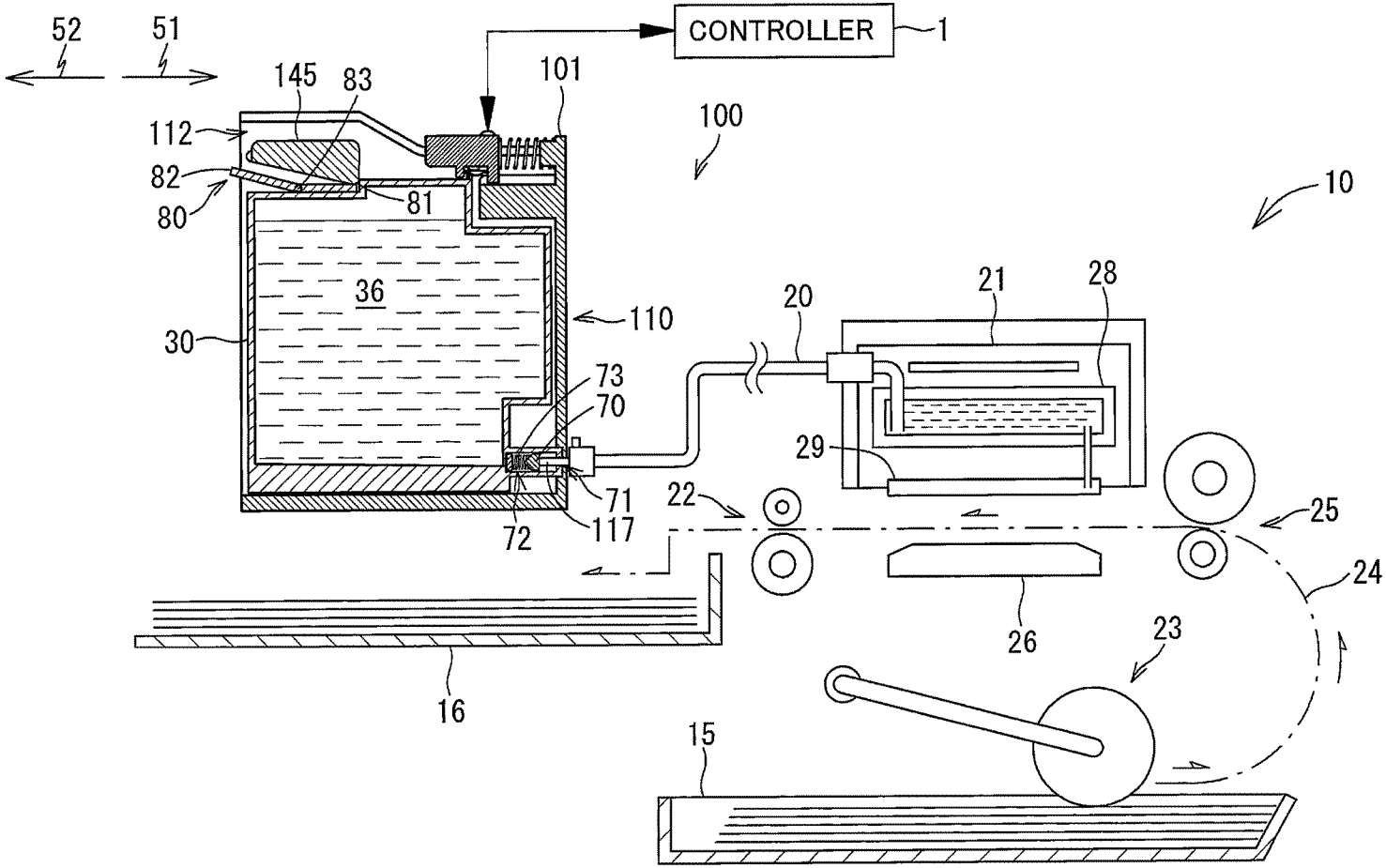
FIG. 1 is a schematic cross-sectional view schematically illustrating an internal structure of a printer 10 according to an embodiment of the invention.

A printer 10 according to an embodiment of the invention will be described while referring to FIGS. 1 through 12. The embodiment described below is only an example of for realizing the invention; it will be appreciated that the embodiment can be appropriately changed without departing from the intended scope of the invention.

In the following description, a direction in which an ink cartridge 30 is inserted into and attached to a cartridge attachment section 110 is defined as an insertion direction 51 (an example of a first direction). A direction opposite to the insertion direction 51, i.e., a direction in which the ink cartridge 30 is removed from the cartridge attachment section 110 is defined as a removal direction 52 (an example of a second direction). The insertion direction 51 and the removal direction 52 are parallel to a horizontal direction in the embodiment, but the insertion direction 51 and the removal direction 52 may not be parallel to the horizontal direction.

A direction orthogonal to the insertion direction 51 and the removal direction 52 is defined as an upward direction 54 (an example of a third direction). A direction opposite to the upward direction 54 is defined as a downward direction 53 (an example of a fourth direction). In the present embodiment, the upward direction 54 as the third direction is a vertically upward direction, while the downward direction 53 as the fourth direction is a vertically downward direction. However, the third direction and fourth direction may not necessarily be the vertical direction.

Further, directions orthogonal to the insertion direction 51 and the downward direction 53 are defined as a rightward direction 55 (an example of a fifth direction) and a leftward direction 56 (an example of a sixth direction). More specifically, when the ink cartridge 30 has been completely attached to the cartridge attachment section 110, that is, when the ink cartridge 30 is in an attached state (usable state), the direction orienting toward the right is defined as the rightward direction 55, while the direction orienting toward the left is defined as the leftward direction 56 when the ink cartridge 30 is viewed in the insertion direction 51. In the present embodiment, the rightward direction 55 as the fifth direction and the leftward direction 56 as the sixth direction are the horizontal direction, but the fifth direction and sixth direction may not necessarily be the horizontal direction.

<Overall Structure of the Printer 10>

As illustrated in FIG. 1, the printer 10 (an example of a system) is configured to selectively discharge ink droplets onto recording sheets to record images based on an inkjet recording scheme. The printer 10 includes an ink supply device 100.

The ink supply device 100 is configured to supply ink to a recording head 21. Referring to FIG. 1, the ink supply device 100 includes the cartridge attachment section 110 (an example of a cartridge attachment section), four ink cartridges 30 (an example of a cartridge), the recording head 21 (an example of a consuming section), and a controller 1 configured to control overall operations of the printer 10. The ink cartridges 30 are attachable to and detachable from the cartridge attachment section 110. The cartridge attachment section 110 has one surface in which an opening 112 is formed. The ink cartridges 30 are inserted into the cartridge attachment section 110 or removed from the cartridge attachment section 110 through the opening 112. Four ink cartridges 30 corresponding to respective colors of cyan, magenta, yellow, and black can be accommodated in the ink supply device 100. Hereinafter, for an explanatory purpose, in the following description and in the drawings, only one ink cartridge 30 is assumed to be attached to the cartridge attachment section 110, wherever necessary.

The ink cartridge 30 stores ink (an example of a consumable material) that can be used in the printer 10. In other words, the ink cartridge 30 accommodates ink. When the ink cartridge 30 is attached to the cartridge attachment section 110, the ink cartridge 30 and the recording head 21 are connected by a corresponding ink tube 20. The recording head 21 includes four sub-tanks 28 corresponding to the four ink cartridges 30. Each sub-tank 28 is configured to temporarily store the ink supplied from the corresponding ink cartridge 30 through the corresponding ink tube 20. The recording head 21 is configured to selectively discharge the ink supplied from the respective sub-tanks 28 through nozzles 29 according to an inkjet recording scheme.

The printer 10 also includes a sheet feeding tray 15, a sheet feeding roller 23, a pair of conveying rollers 25, a platen 26, a pair of discharge rollers 22, and a sheet discharge tray 16. A recording sheet is fed from the sheet feeding tray 15 to a conveying path 24 by the sheet feeding roller 23, and is then conveyed onto the platen 26 by the pair of conveying rollers 25. The recording head 21 selectively discharges ink onto the recording sheet that passes over the platen 26 to form an inked image on the recording sheet. In this way, the ink stored in the ink cartridge 30 completely attached to the cartridge attachment section 110 is consumed by the recording head 21. The recording sheet having passed over the platen 26 is finally discharged by the pair of discharge rollers 22 onto the sheet discharge tray 16 that is positioned most downstream in the conveying path 24.

<Ink Cartridge 30>

Figure 2A:
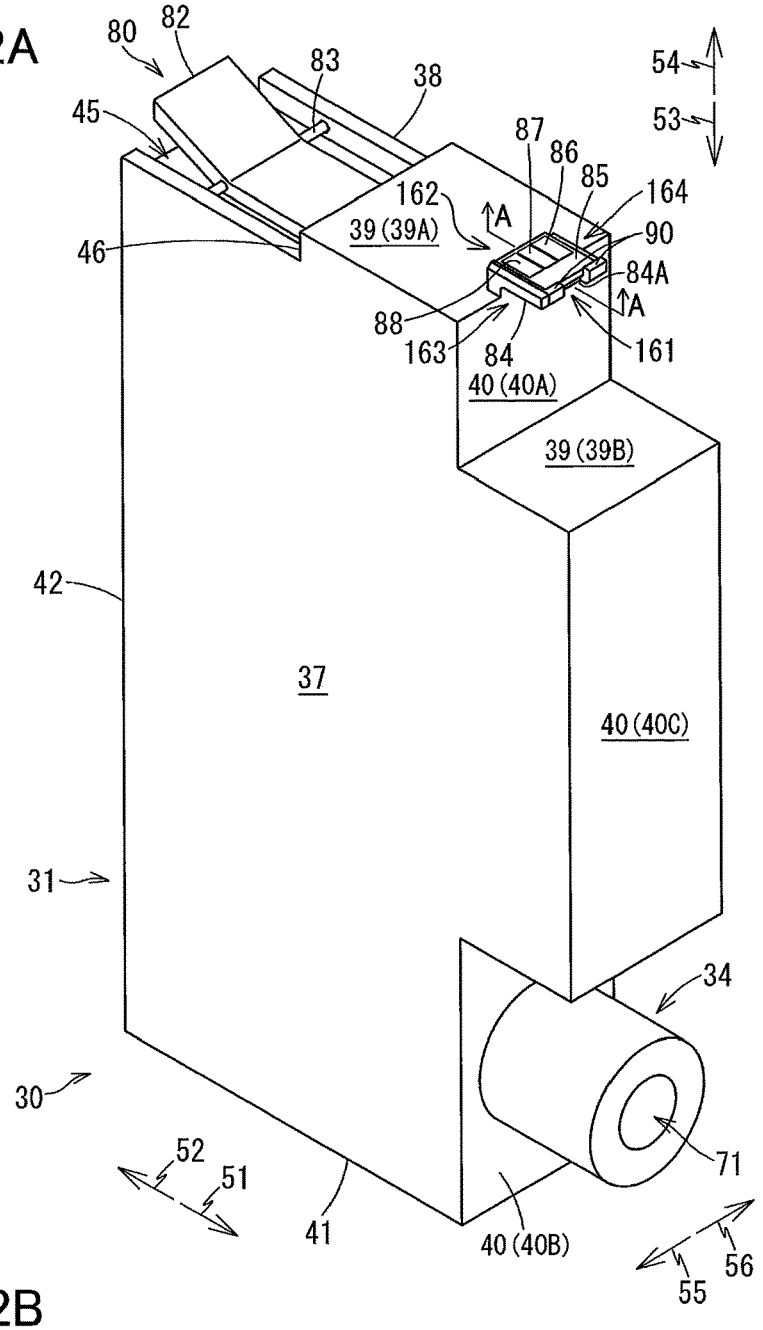
FIG. 2A is a perspective view illustrating an external configuration of an ink cartridge 30 according to the embodiment.

The ink cartridge 30 shown in FIGS. 1 and 2 is a container for storing ink. The ink cartridge 30 has a space formed therein that serves as an ink chamber 36 for storing ink (see FIG. 1). The ink chamber 36 of the embodiment is formed by a housing constituting a main body 31 of the ink cartridge 30. However, the ink chamber 36 may be formed by an inner frame that is a separate member from the housing of the main body 31 defining an outer shape of the ink cartridge 30, for example.

When the ink cartridge 30 is attached to the ink supply device 100, the ink cartridge 30 is in a posture shown in FIGS. 1 and 2. This posture of the ink cartridge 30 shown in FIGS. 1 and 2 is referred to as an attached posture. The ink cartridge 30 includes a front wall 40, a rear wall 42, a top wall 39, a bottom wall 41, a side wall 37, and a side wall 38, as will be described later. In the attached posture illustrated in FIGS. 1 and 2, a direction from the rear wall 42 toward the front wall 40 is coincident with the insertion direction 51, a direction from the front wall 40 toward the rear wall 42 is coincident with the removal direction 52, a direction from the top wall 39 toward the bottom wall 41 is coincident with the downward direction 53, a direction from the bottom wall 41 toward the top wall 39 is coincident with the upward direction 54, a direction from the side wall 38 toward the side wall 37 is coincident with the rightward direction 55, and a direction from the side wall 37 toward the side wall 38 is coincident with the leftward direction 56. When the ink cartridge 30 is being inserted into and attached to the cartridge attachment section 110, an outer surface of the front wall 40 faces in the insertion direction 51, an outer surface of the rear wall 42 faces in the removal direction, an outer surface of the bottom wall 41 faces in the downward direction 53, an outer surface of the top wall 39 faces in the upward direction 54, an outer surface of the side wall 37 faces in the rightward direction 55, and an outer surface of the side wall 38 faces in the leftward direction 56.

The ink cartridge 30 includes the main body 31 of a substantially flat rectangular parallelepiped shape. The ink cartridge 30 may have other three-dimensional shape configured of flat or curved surfaces. The main body 31 has a width in the rightward direction 55 and the leftward direction 56, a height in the upward direction 54 and the downward direction 53, and a depth in the insertion direction 51 and the removal direction 52, the height and depth being larger than the width.

As illustrated in FIG. 2, the main body 31 includes the front wall 40, the rear wall 42, the side wall 37, the side wall 38, the top wall 39, and the bottom wall 41.

The front wall 40 and the rear wall 42 are disposed in separation from each other in the insertion direction 51 and the removal direction 52.

The side wall 37 (right side wall 37) connects right ends of the front wall 40 and the rear wall 42. The side wall 38 (left side wall 38) connects left ends of the front wall 40 and the rear wall 42. The top wall 39 connects upper ends of the front wall 40 and the rear wall 42. The bottom wall 41 connects lower ends of the front wall 40 and the rear wall 42.

The front wall 40 includes a first front wall 40A, a second front wall 40B, and a third front wall 40C. The first front wall 40A constitutes an upper end portion of the front wall 40. The second front wall 40B constitutes a lower end portion of the front wall 40. The third front wall 40C constitutes a generally center portion of the front wall 40 in the upward direction 54 and the downward direction 53. The third front wall 40C is positioned offset in the insertion direction 51 (i.e., frontward) relative to the first front wall 40A and second front wall 40B. That is, the third front wall 40C is positioned downward of the first front wall 40A and the second front wall 40B in the insertion direction 51. The top wall 39 includes a first top wall 39A and a second top wall 39B. The first top wall 39A is positioned offset in the removal direction 52 (i.e., rearward) relative to a general center of the top wall 39 in the insertion direction 51 and the removal direction 52. The second top wall 39B is positioned offset in the insertion direction 51 (i.e., frontward) relative to the general center of the top wall 39 in the insertion direction 51 and the removal direction 52. The second top wall 39B is positioned offset in the downward direction 53 relative to the first top wall 39A. That is, the second top wall 39B is positioned downstream of the first top wall 39A in the downward direction 53.

The ink chamber 36 is defined by the front wall 40, the rear wall 42, the side wall 37, the side wall 38, the top wall 39, and the bottom wall 41. That is, the main body 31 accommodates ink in the ink chamber 36.

On the lower end portion of the front wall 40 (on the second front wall 40B), an ink supply portion 34 is provided. The ink supply portion 34 has a cylindrical outer shape and protrudes in the insertion direction 51 from the second front wall 40B. The ink supply portion 34 has a protruding end in which an ink supply opening 71 is formed.

As illustrated in FIG. 1, the ink supply portion 34 defines an internal space therein serving as an ink passage 72. The ink passage 72 extends in the insertion direction 51 and the removal direction 52 and connects between the ink supply opening 71 and the ink chamber 36. The ink passage 72 has an open end in communication with outside of the main body 31 through the ink supply opening 71. The ink passage 72 extends in the removal direction 52 from the ink supply opening 71 to be in fluid communication with the ink chamber 36 (inside of the main body 31). An ink supply valve 70 and a coil spring 73 are disposed within the ink passage 72. The coil spring 73 applies a biasing force to the ink supply valve 70 to bias the ink supply valve 70 toward the ink supply opening 71. Thus the ink supply opening 71 can be opened and closed by the ink supply valve 70 due to the biasing force of the coil spring 73. When the ink cartridge 30 is attached to the cartridge attachment section 110, an ink needle 117 provided in the cartridge attachment section 110 is inserted into the ink supply opening 71, thereby moving the ink supply valve 70 away from the ink supply opening 71 against the biasing force of the coil spring 73. In this way, the ink in the ink chamber 36 is allowed to flow, through the ink passage 72, into the ink needle 117 provided on the cartridge attachment section 110.

The ink supply opening 71 may not necessarily be opened and closed by the ink supply valve 70. As an alternative, for example, the ink supply opening 71 may be covered by a film. In this case, when the ink cartridge 30 is attached to the cartridge attachment section 110, the ink needle 117 pierces through the film to open the ink supply opening 71. Further, although not illustrated in the present embodiment, an air communication port may be formed in the main body 31 to bring the ink chamber 36 maintained in a negative pressure into an ambient pressure.

As illustrated in FIG. 2, the top wall 39 is provided with a locking portion 45 at a position closer to the rear wall 42 than the first top wall 39A is to the rear wall 42. The locking portion 45 includes a groove formed in the top wall 39 and extending in the insertion direction 51 and the removal direction 52. The groove has an end surface in the insertion direction 51 serving as a locking surface 46 of the locking portion 45. The locking surface 46 faces in the removal direction 52 of the ink cartridge 30. The cartridge attachment section 110 is provided with an engagement member 145 (an example of a locking part, see FIG. 4), as will be described later. When the ink cartridge 30 is attached to the cartridge attachment section 110, the engagement member 145 is configured to engage the locking surface 46. The locking surface 46 is configured to receive an external force acting in a direction opposite to the biasing force that pushes the ink cartridge 30 in the removal direction 52. In other words, in the present embodiment, the locking surface 46 can receive a force applied from the engagement member 145. The groove of the locking portion 45 has another end in the removal direction 52 that is open to the outside of the main body 31.

A pivot member 80 is provided on the locking portion 45 of the main body 31. The pivot member 80 has a bent flat plate-like shape, for example, and is elongated in the insertion direction 51 and the removal direction 52. The pivot member 80 has a bent portion at which a shaft 83 is provided. The shaft 83 extends in the rightward direction 55 and leftward direction 56 to allow the pivot member 80 to pivot about the shaft 83. The pivot member 80 includes a tip end portion 81 and a rear end portion 82. The tip end portion 81 extends in the insertion direction 51 from the shaft 83. The rear end portion 82 extends in the removal direction 52 from the shaft 83.

When the pivot member 80 is pivoted upward until the tip end portion 81 reaches its uppermost position, the tip end portion 81 protrudes above the top wall 39 of the main body 31. When the tip end portion 81 of the pivot member 80 is pressed downward, the pivot member 80 is caused to pivot clockwise in FIG. 1. When the pivot member 80 has pivoted clockwise to its full extent, the tip end portion 81 is located near a lower end of the locking surface 46. Instead of the depicted structure of the pivot member 80, the pivot member 80 may be integrated with the main body 31. Still alternatively, the pivot member 80 may be biased clockwise by a coil spring, or may be configured to pivot clockwise or counterclockwise by its own weight.

As illustrated in FIG. 2, a board supporting portion 84 is provided on the first top wall 39A of the main body 31. The board supporting portion 84 protrudes in the upward direction 54 from an upper surface of the first top wall 39A. The board supporting portion 84 also protrudes in the insertion direction 51 from an end of the first top wall 39A in the insertion direction 51 (i.e., front end). The board supporting portion 84 is positioned above the second top wall 39B to oppose the second top wall 39B. The board supporting portion 84 is a substantially thin plate-like shaped member having a rectangular parallelepiped shape. The board supporting portion 84 may be formed separately from the first top wall 39A, or may be integrally formed with the first top wall 39A. Still alternatively, the board supporting portion 84 may have a shape other than the rectangular parallelepiped shape.

The board supporting portion 84 has an upper surface on which an IC board 85 (an example of a board) is fixed by a well-known method, such as adhesion. That is, the board supporting portion 84 supports the IC board 85. More specifically, the board supporting portion 84 supports a lower surface (example of a supported surface) of the IC board 85. Preferably, the IC board 85 has a length in the insertion direction 51 and the removal direction 52 equal to or smaller than a length in the insertion direction 51 and the removal direction 52 of the board supporting portion 84. In the present embodiment, the length of the IC board 85 in the insertion direction 51 and the removal direction 52 (front-rear length) is smaller than the length of the board supporting portion 84 in the insertion direction 51 and the removal direction 52. The board supporting portion 84 has an extension end 84A (an example of a contact end) that protrudes further in the insertion direction 51 relative to the IC board 85 supported by the board supporting portion 84. The board supporting portion 84 has another end in the removal direction 52 (i.e., rear end) opposite to the extension end 84A. The end of the board supporting portion 84 in the removal direction 52 may be at the same position as the end of the IC board 85 in the removal direction 52; or may protrude further in the removal direction 52 than the end of the IC board 85 in the removal direction 52; or conversely, may be retracted in the insertion direction 51 than the end of the IC board 85 in the removal direction 52.

The board supporting portion 84 also includes a pair of convex portions 90 (an example of a positioning portion). The convex portions 90 protrude in the upward direction 54 from the extension end 84A. In the present embodiment, the two convex portions 90 are arranged in the rightward direction 55 and the leftward direction 56 to define a gap therebetween. Each convex portion 90 has a surface facing in the removal direction 52 (rear surface) that makes contact with an end surface of the IC board 85 facing in the insertion direction 51 (front surface). In other words, the IC board 85 is supported on the board supporting portion 84 such that the end surface of the IC board 85 facing in the insertion direction 51 is in abutment contact with the convex portions 90. The IC board 85 is thus fixed in position in the insertion direction 51 relative to the board supporting portion 84. In the present embodiment, the surfaces of the convex portions 90 facing in the removal direction 52 (i.e., the rear surfaces of the convex portions 90) are positioned offset in the removal direction 52 relative to the surface of the extension end 84A facing in the insertion direction 51 (i.e., front surface of the extension end 84A).

In the gap formed between the two convex portions 90, a first wall 171 of a slider 170 (described later) provided at the cartridge attachment section 110 can be inserted. The first wall 171 inserted into this gap can make contact with at least one of the board supporting portion 84 and the IC board 85 which are exposed from the gap between the two convex portions 90 when viewed in the removal direction 52 (i.e., in the present embodiment, the surface of the extension end 84A of the board supporting portion 84 facing in the insertion direction 51). In other words, the first wall 171 can make contact with at least one of the board supporting portion 84 and the IC board 85 at a different position from the convex portions 90.

The convex portions 90 may be provided at positions different from the positions shown in FIG. 2 in the rightward direction 55 and the leftward direction 56. For example, only one convex portion 90 may be formed at a position rightward relative to a center of the board supporting portion 84 in the rightward direction 55 and the leftward direction 56.

In this case, the first wall 171 can be inserted such that the first wall 171 is positioned adjacent to the sole convex portion 90 and leftward of the center of the board supporting portion 84 in the rightward direction 55 and the leftward direction 56.

Figure 2B:
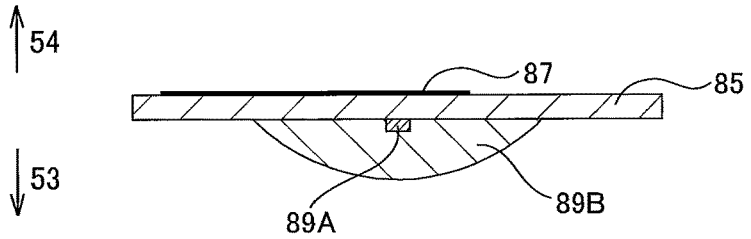
FIG. 2B is a cross-sectional view of an IC board 85 of the ink cartridge 30 according to the embodiment taken along a plane A-A shown in FIG. 2A.

The IC board 85 has an upper surface (i.e., a surface facing in the upward direction 54) on which three electrodes 86, 87 and 88 are provided. This upper surface of the IC board 85 is an example of a mount surface. The respective electrodes 86, 87 and 88 (examples of an electrical interface) extend in the insertion direction 51 and the removal direction 52. The electrodes 86, 87 and 88 are arranged to be spaced away from one another in the rightward direction 55 and the leftward direction 56. The electrodes 86, 87 and 88 are a HOT electrode, a GND electrode, and a signal electrode, respectively, for example. Further, the IC board 85 has a lower surface (i.e., a surface facing in the downward direction 53) on which an IC 89A is mounted, as shown in FIG. 2B. This lower surface of the IC board 85 is an example of a supported surface. The IC 89A is covered with a protection layer 89B made of an electrically insulating material. The upper surface of the board supporting portion 84 is formed with a recess (now shown), so that the protective layer 89B covering the IC 89A can be received in the recess when the lower surface of the IC board 85 is fixed to the upper surface of the board supporting portion 84. The IC 89A (an example of an integrated circuit) is a semiconductor integrated circuit and is electrically connected to the respective electrodes 86, 87 and 88. The IC 89A can store data indicative of information on the ink cartridge 30 (lot number, date of production, for example) as well as information on ink (color of ink, for example). External access to the IC 89A enables the data stored in the IC 89A to be retrieved therefrom electrically. The number of electrode may not be limited to three. Less than or more than three electrodes may be provided on the IC board 85.

The board supporting portion 84 is disposed to protrude both in the upward direction 54 and in the insertion direction 51 from the first top wall 39A. When the ink cartridge 30 is completely attached to the cartridge attachment section 110, the ink cartridge 30 and the cartridge attachment section 110 define spaces therebetween near the board supporting portion 84 and the IC board 85. These spaces will be described below in detail.

Specifically, four spaces (a first space 161, a second space 162, a third space 163, and a fourth space 164) are defined in the vicinity of the board supporting portion 84 and the IC board 85, as illustrated in FIG. 2. The first space 161 is a space positioned offset in the insertion direction 51 relative to the board supporting portion 84 and the IC board 85. That is, the first space 161 is positioned downstream of the board supporting portion 84 and the IC board 85 in the insertion direction 51. Although the cartridge attachment section 110 is not illustrated in FIG. 2, the first space 161 is defined by: the second top wall 39B; surfaces of the board supporting portion 84 and the IC board 85 oriented in the insertion direction 51; a side wall 182 of the cartridge attachment section 110; a side wall 183 of the cartridge attachment section 110; and an end wall 181 (see FIG. 4) of the cartridge attachment section 110. The first space 161 is large enough for accommodating the first wall 171 of the slider 170. When the ink cartridge 30 is completely attached to the cartridge attachment section 110, the first wall 171 is disposed in the first space 161. Put another way, the first space 161 is a space for receiving the first wall 171 therein.

The second space 162 is a space positioned offset in the removal direction 52 relative to the board supporting portion 84 and IC board 85. That is, the second space 162 is positioned downstream of the board supporting portion 84 and the IC board 85 in the removal direction 52. Although the cartridge attachment section 110 is not illustrated in FIG. 2, the second space 162 is defined by: the first top wall 39A; the surfaces of the board supporting portion 84 and the IC board 85 oriented in the removal direction 52; the side wall 182 of the cartridge attachment section 110; and the side wall 183 of the cartridge attachment section 110. The second space 162 is large enough for accommodating a second wall 172 (described later, shown in FIG. 5B) of the slider 170 (more precisely, the second wall 172 of the slider 170 at a first position and in a first posture). When the ink cartridge 30 is completely attached to the cartridge attachment section 110, the second wall 172 of the slider 170 at the first position and in the first posture is disposed in the second space 162. In other words, the second space 162 is a space for receiving the second wall 172 of the slider 170 at the first position and in the first posture.

It should be noted that, the first space 161 may be formed in a region positioned offset in the insertion direction 51 (frontward) relative to the IC board 85 and a portion of the board supporting portion 84. Here, "a portion of the board supporting portion 84" means a portion of the board supporting portion 84 that overlaps with the first wall 171 when viewed in the insertion direction 51. Further, the second space 162 may be formed in a region positioned offset in the removal direction 52 (rearward) relative to the IC board 85 and a portion of the board supporting portion 84. Here, "a portion of the board supporting portion 84" means a portion of the board supporting portion 84 that overlaps with the second wall 172 of the slider 170 at the first position and in the first posture when viewed in the insertion direction 51.

The third space 163 is a space positioned rightward of the IC board 85 (offset in the rightward direction 55 relative to the IC board 85). That is, the third space 163 is positioned downstream of the IC board 85 in the rightward direction 55. Although the cartridge attachment section 110 is not illustrated in FIG. 2, the third space 163 is defined by: the second top wall 39B; right surfaces of the board supporting portion 84 and IC board 85; and the side wall 182 of the cartridge attachment section 110. The third space 163 is large enough for accommodating a third wall 173 of the slider 170 (described later, shown in FIG. 5B). When the ink cartridge 30 is completely attached to the cartridge attachment section 110, the third wall 173 is disposed in the third space 163. That is, the third space 163 is a space for receiving the third wall 173 therein.

The fourth space 164 is a space positioned leftward of the IC board 85 (offset in the leftward direction 56 relative to the IC board 85). That is, the fourth space 164 is positioned downstream of the IC board 85 in the leftward direction 56. Although the cartridge attachment section 110 is not illustrated in FIG. 2, the fourth space 164 is defined by: the second top wall 39B; left surfaces of the board supporting portion 84 and IC board 85; and the side wall 183 of the cartridge attachment section 110. The fourth space 164 is large enough for accommodating a fourth wall 174 of the slider 170 (described later, shown in FIG. 5B). When the ink cartridge 30 is completely attached to the cartridge attachment section 110, the fourth wall 174 is disposed in the fourth space 164. That is, the fourth space 164 is a space for receiving the fourth wall 174 therein.

<Cartridge Attachment Section 110>

Figure 3:
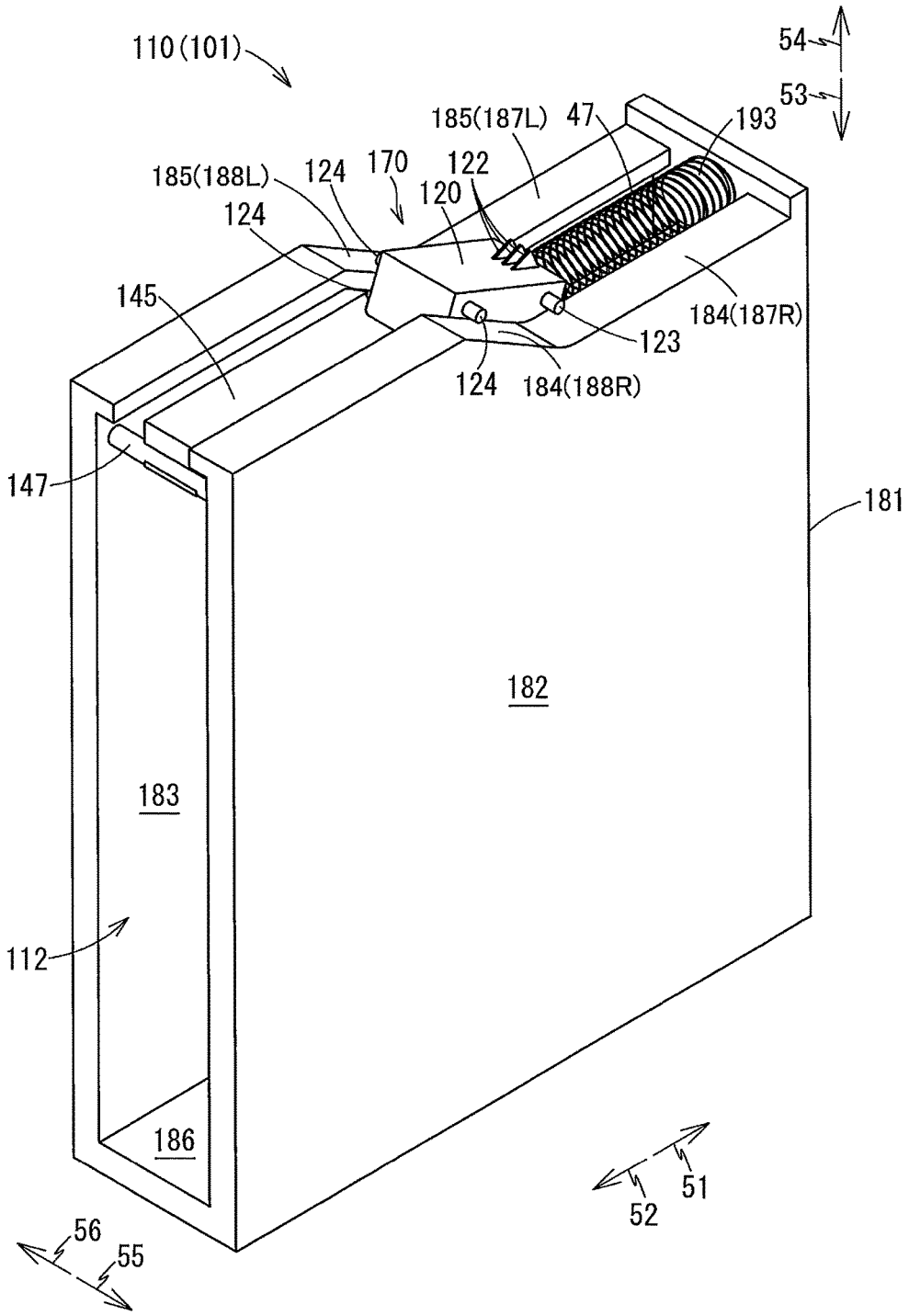
FIG. 3 is a perspective view illustrating an external configuration of a cartridge attachment section 110 according to the embodiment.
Figure 4:
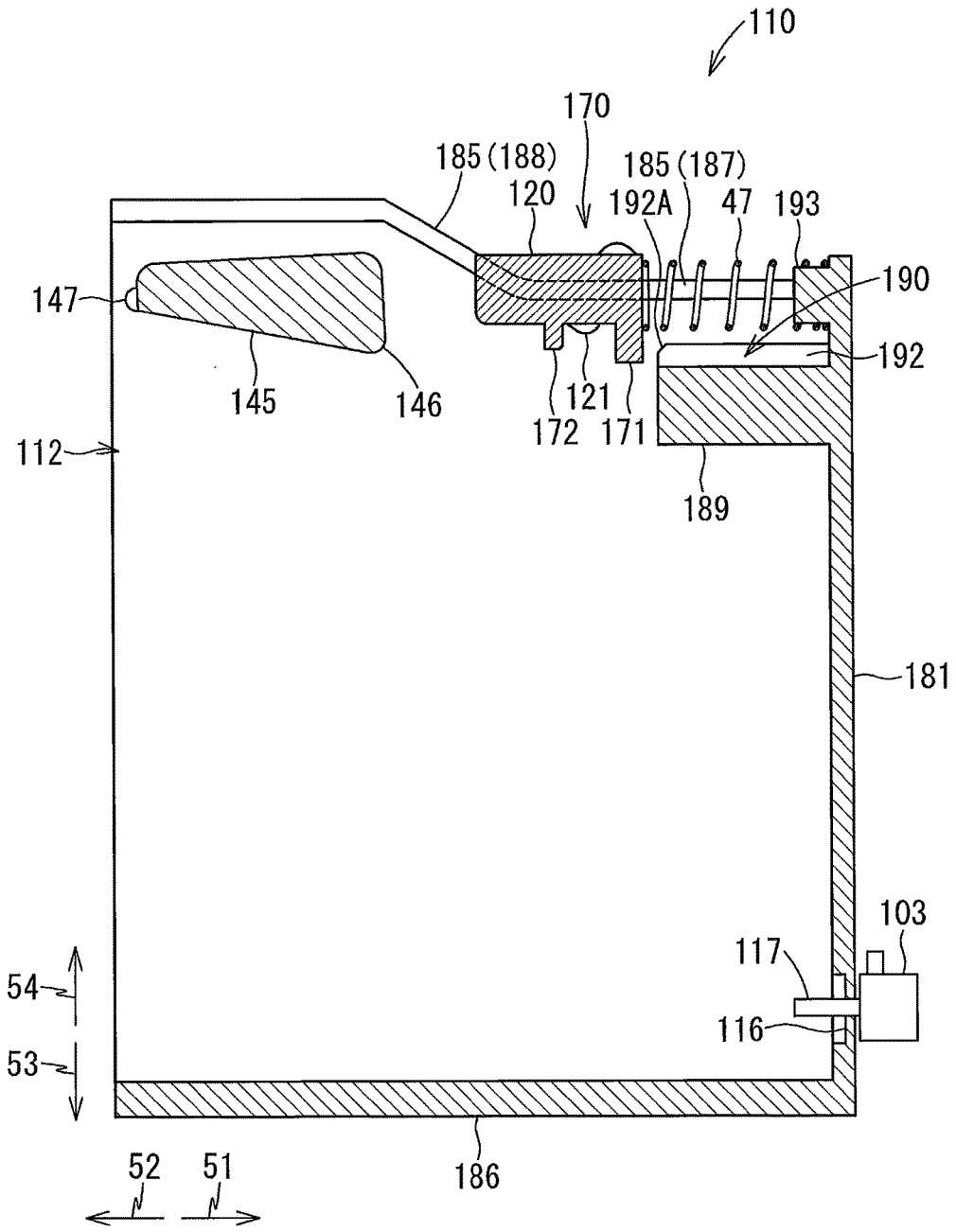
FIG. 4 is a cross-sectional view illustrating a configuration of the cartridge attachment section 110.

As illustrated in FIGS. 3 and 4, the cartridge attachment section 110 includes a case 101 that constitutes a casing of the cartridge attachment section 110. The case 101 has a substantially rectangular parallelepiped box shape formed with the opening 112. Through the opening 112, an internal space of the case 101 is exposed to a surface of the printer 10 that a user faces when using the printer 10. The ink cartridge 30 is inserted into and removed from the case 101 through the opening 112. The case 101 can accommodate therein four ink cartridges 30 corresponding to the respective colors of cyan, magenta, yellow, and black. However, for an explanatory purpose, FIG. 4 depicts a state where only one ink cartridge 30 is assumed to be accommodated in the case 101. More specifically, a connecting portion 103, the engagement member 145, the slider 170, and a coil spring 47 are provided in the case 101 for each of the four ink cartridges 30 accommodated in the case 101. That is, in the present embodiment, the case 101 includes four connecting portions 103, four engagement members 145, four sliders 170, and four coil springs 47. The four connecting portions 103 are arranged in the rightward direction 55 and the leftward direction 56, and have the same configuration as each other. Similarly, the four engagement members 145 are arranged in the rightward direction 55 and the leftward direction 56 and have the same structure. The four sliders 170 are also arranged in the rightward direction 55 and the leftward direction 56, and have the same configuration as each other. The four coil springs 47 are also arranged in the rightward direction 55 and the leftward direction 56 and have the same configuration as each other. Thus, in the following description, for simplifying the explanation, detailed descriptions will be given only for one of the connecting portions 103, one of the engagement members 145, one of the sliders 170, and one of the coil springs 47, whereas descriptions for the remaining three connecting portions 103, three engagement members 145, three sliders 170, and three coil springs 47 will be omitted.

The case 101 includes the end wall 181, the side wall 182, the side wall 183, a first top wall 184, a second top wall 185, and a bottom wall 186.

The end wall 181 is a wall that is adapted to face the front wall 40 of the ink cartridge 30 in the insertion direction 51 and the removal direction 52 when the ink cartridge 30 is attached to the cartridge attachment section 110.

The side wall 182 is a wall that extends in the removal direction 52 from a right end of the end wall 181. The side wall 182 is adapted to face the side wall 37 of the ink cartridge 30 in the rightward direction 55 and the leftward direction 56 when the ink cartridge 30 is attached to the cartridge attachment section 110. The side wall 183 is a wall that extends in the removal direction 52 from a left end of the end wall 181. The side wall 183 is adapted to face the side wall 38 of the ink cartridge 30 in the rightward direction 55 and the leftward direction 56 when the ink cartridge 30 is attached to the cartridge attachment section 110.

The first top wall 184 is a wall that extends leftward from an upper end of the side wall 182 and is also connected to an upper end of the end wall 181. The second top wall 185 is a wall that extends rightward from an upper end of the side wall 183 and is also connected to the upper end of the end wall 181. The first top wall 184 and second top wall 185 are configured to face the top wall 39 of the ink cartridge 30 in the upward direction 54 and the downward direction 53 when the ink cartridge 30 is attached to the cartridge attachment section 110. The first top wall 184 and second top wall 185 are arranged to define a gap therebetween in the rightward direction 55 and the leftward direction 56. As will be described later, the slider 170 is movably provided in this gap.

The bottom wall 186 is a wall configured to support the bottom wall 41 of the ink cartridge 30 from below when the ink cartridge 30 is attached to the cartridge attachment section 110.

Each of the first top wall 184 and second top wall 185 includes a first guide part 187 and a second guide part 188. Each first guide part 187 extends in the removal direction 52 from the upper end of the end wall 181. Each second guide part 188 extends from one end of the corresponding first guide part 187 in the removal direction 52 (i.e., rear end) and is inclined relative to the first guide parts 187 such that the second guide parts 188 extend diagonally in the upward direction 54 toward downstream in the removal direction 52. In other words, each second guide part 188 is inclined relative to the corresponding first guide part 187 such that the end of the second guide part 188 in the removal direction 52 (rear end) is positioned offset in the upward direction 54 relative to the end of the first guide part 187 in the removal direction 52 (rear end) from which the second guide part 188 extends, the rear end of the second guide part 188 being positioned downstream of the rear end of the first guide part 187 in the removal direction 52. Hereinafter, for an explanatory purpose, the first guide part 187 and the second guide part 188 constituting the first top wall 184 will be referred as "right first guide part 187R" and "right second guide part 188R," wherever necessary. Likewise, for an explanatory purpose, the first guide part 187 and the second guide part 188 constituting the second top wall 185 will be referred as "left first guide part 187L" and "left second guide part 188L," wherever necessary.

The opening 112 is defined by rear ends (ends in the removal direction 52) of the side wall 182, the side wall 183, the first top wall 184, the second top wall 185, and the bottom wall 186.

The connecting portion 103 is provided on a lower portion of the end wall 181. The connecting portion 103 is disposed at a position corresponding to the ink supply portion 34 of the ink cartridge 30 attached to the case 101.

The connecting portion 103 includes the ink needle 117 and a retention groove 116. The ink needle 117 is formed of a resin having a tubular configuration. The ink needle 117 penetrates the end wall 181 in the insertion direction 51 and removal direction 52 to connect the inside and outside of the case 101. The ink needle 117 has an outer end connected to the ink tube 20. The ink tube 20 connected to the ink needle 117 extends to the recording head 21 to allow ink to be supplied to the recording head 21. The ink tube 20 is not illustrated in FIG. 4.

Figure 9:
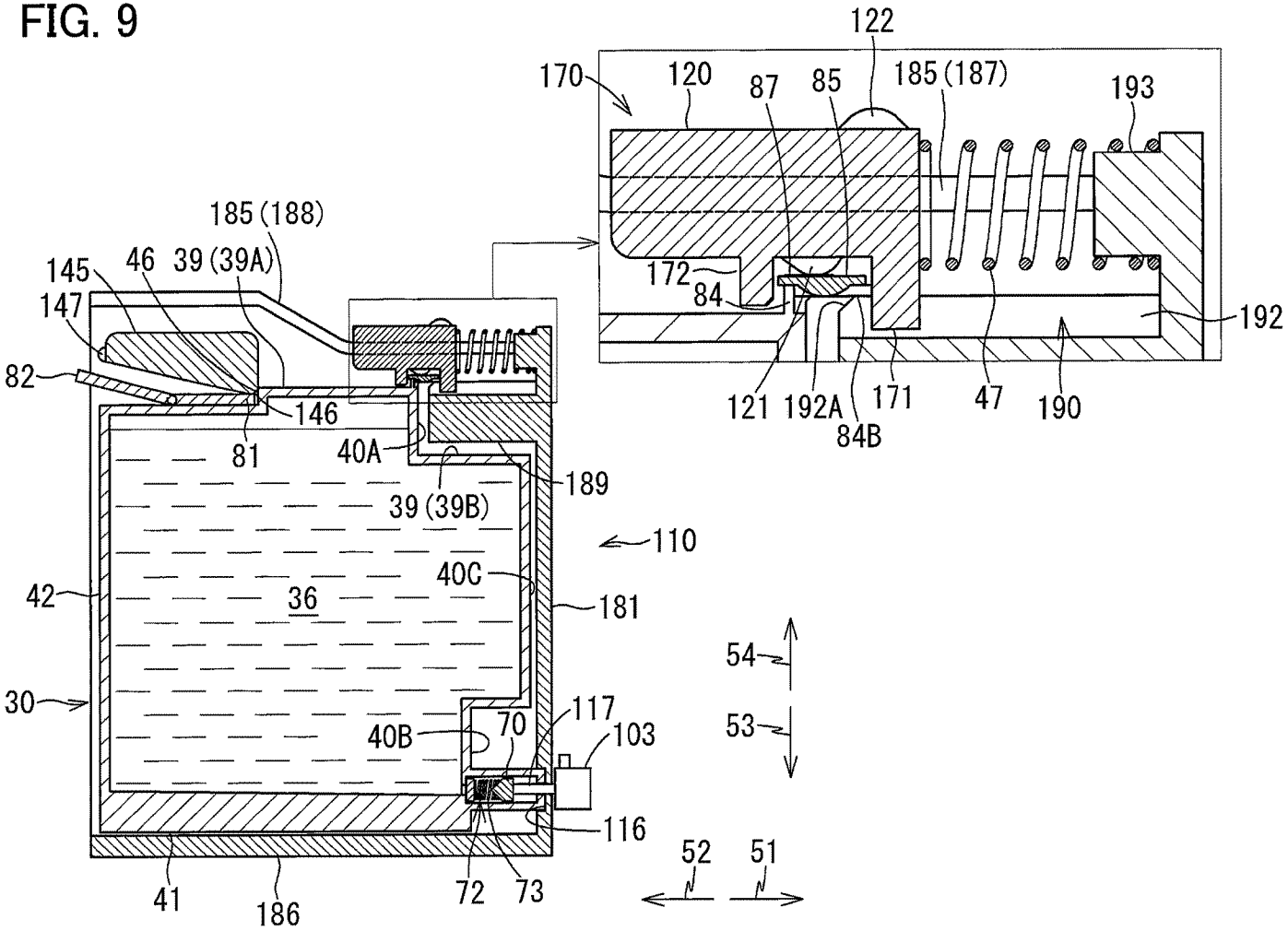
FIG. 9 is a cross-sectional view of the ink cartridge 30 and the cartridge attachment section 110, wherein the ink cartridge 30 has been inserted into the cartridge attachment section 110 until the slider 170 is at a first position.

The retention groove 116 is a cylindrical-shaped groove formed in the end wall 181. The ink needle 117 is disposed at the center of the retention groove 116. As illustrated in FIG. 9, when the ink cartridge 30 is attached to the cartridge attachment section 110, the ink supply portion 34 is inserted into the retention groove 116. At this time, an outer circumferential surface of the cylindrical-shaped ink supply portion 34 makes contact with a cylindrical-shaped inner circumferential surface defining the retention groove 116 formed in the end wall 181. When the ink supply portion 34 is inserted into the retention groove 116, the ink needle 117 is inserted into the ink supply opening 71 of the ink supply portion 34. The ink stored in the ink chamber 36 is thus allowed to flow out therefrom. The ink flowing out from the ink chamber 36 is supplied to the recording head 21 through the ink needle 117 and the ink tube 20.

The engagement member 145 is provided on the case 101 to maintain the ink cartridge 30 attached to the cartridge attachment section 110 in the attached state. The engagement member 145 is capable of pivoting about a support shaft 147 provided near the opening 112 of the case 101, for example. Specifically, the engagement member 145 is configured to be pivot clockwise and counterclockwise in FIG. 4 about the support shaft 147. The engagement member 145 is elongated in the insertion direction 51 and removal direction 52 and has an end in the removal direction 52 at which the support shaft 147 is provided. The engagement member 145 has a distal end opposite to the support shaft 147 in the insertion direction 51 and the removal direction 52 at which an engagement end 146 is formed. The engagement end 146 of the engagement member 145 can engage the locking surface 46 of the ink cartridge 30 when the ink cartridge 30 is completely attached to the cartridge attachment section 110, thereby restricting the main body 31 of the ink cartridge 30 from moving in the removal direction 52 against the biasing force of the coil spring 73 and the coil spring 47 (described later). The ink cartridge 30 can be thus held in the cartridge attachment section 110.

The engagement member 145 is at a lock position (shown in FIG. 9) where the engagement end 146 and the locking surface 46 are in engagement with each other. The engagement member 145 is at an unlock position (shown in FIGS. 6 to 8) where the engagement end 146 and the locking portion 45 are disengaged from each other. The engagement member 145 can pivot in the downward direction 53 by its own weight. When the tip end portion 81 of the pivot member 80 is caused to pivot in the upward direction 54 in the state of FIG. 9, the tip end portion 81 pushes the engagement member 145 at the lock position in the upward direction 54 to cause the engagement member 145 to pivotally move in the upward direction 54 about the support shaft 147. The engagement member 145 is thus moved from the lock position to the unlock position.

Figure 11:
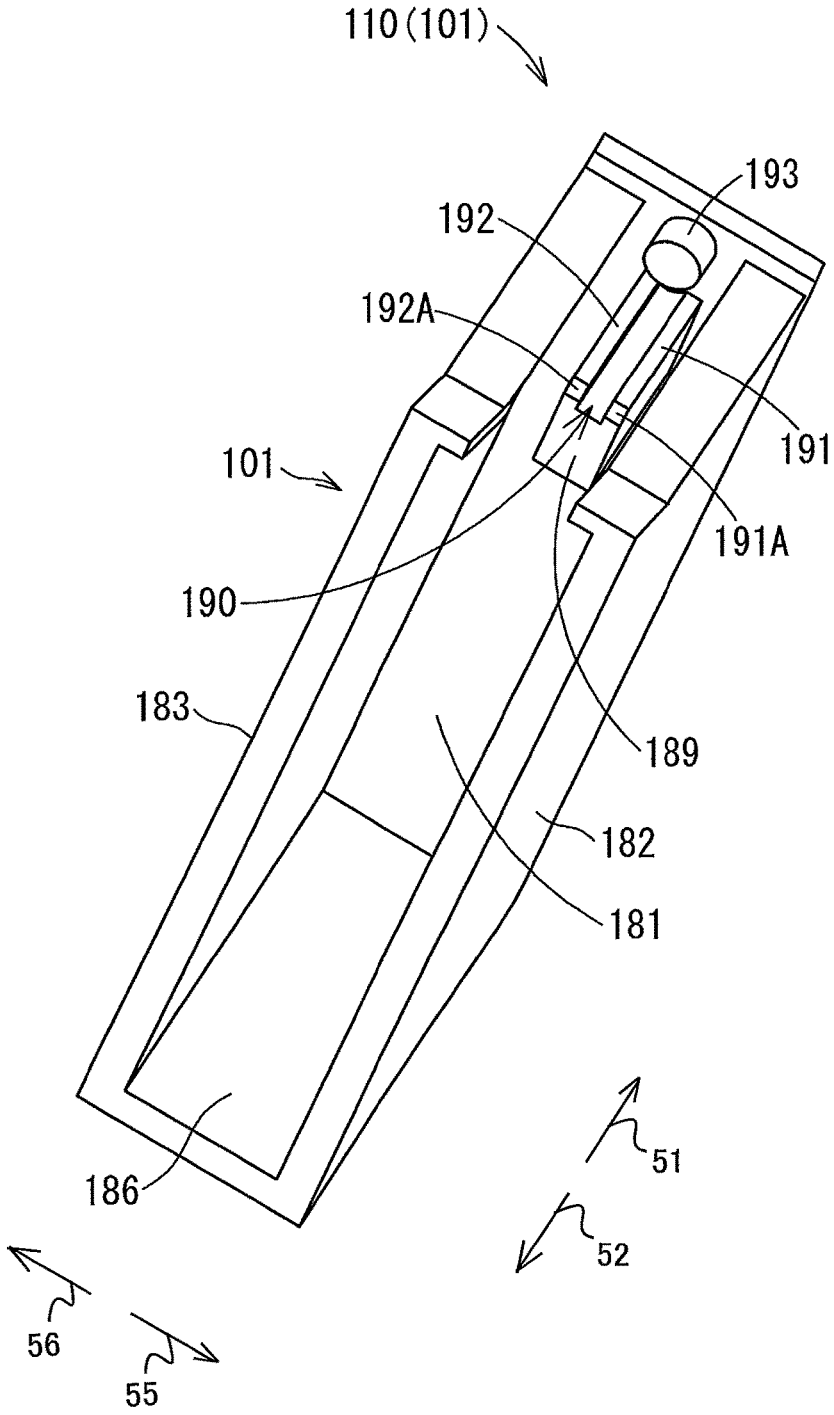
FIG. 11 is a perspective view illustrating an external configuration of a part of a case 101 constituting the cartridge attachment section 110.

As illustrated in FIG. 11, the case 101 is further provided with a protruding portion 189 (an example of a restricting portion). The protruding portion 189 protrudes in the removal direction 52 from an inner surface of the end wall 181 (i.e., the surface oriented in the removal direction 52). The protruding portion 189 includes a first protruding part 191 (an example of a first restricting part) and a second protruding part 192 (an example of a second restricting part). The first protruding part 191 protrudes in the upward direction 54 from an upper surface of the protruding portion 189 at a right end thereof. The second protruding part 192 protrudes in the upward direction 54 from the upper surface of the protruding portion 189 at a left end thereof. The first protruding part 191 and second protruding part 192 extend in the insertion direction 51 and the removal direction 52. The first protruding part 191 and second protruding part 192 are spaced apart from each other in the rightward direction 55 and the leftward direction 56 to define a groove 190 therebetween. The groove 190 extends in the insertion direction 51 and the removal direction 52.

The protruding portion 189 is provided at a position that satisfies the following conditions. Namely, when the ink cartridge 30 is completely attached to the cartridge attachment section 110, upper surfaces of the first protruding part 191 and second protruding part 192 can make contact with a surface of the board supporting portion 84 that is oriented in the downward direction 53 (i.e., a lower surface 84B of the board supporting portion 84) of the ink cartridge 30 (refer to FIGS. 6 to 9). The lower surface 84B is an example of a contact surface. With this structure, the protruding portion 189 can restrict the board supporting portion 84 from being displaced in the downward direction 53. Further, when the ink cartridge 30 is completely attached to the cartridge attachment section 110, the first wall 171 of the slider 170 at the first position is inserted into the groove 190. In other words, the first wall 171 of the slider 170 at the first position is positioned between the first protruding part 191 and the second protruding part 192 in the rightward direction 55 and the leftward direction 56.

The first protruding part 191 has an end in the removal direction 52 (rear end) on which an inclined surface 191A (an example of a guide surface) is formed. Likewise, the second protruding part 192 has an end in the removal direction 52 (rear end) on which an inclined surface 192A (another example of a guide surface) is formed. Both of the inclined surfaces 191A and 192A are inclined relative to the first protruding part 191 and second protruding part 192, respectively, to extend diagonally in the upward direction 54 toward downstream in the insertion direction 51. That is, the inclined surfaces 191A and 192A both extend diagonally upward and frontward.

As illustrated in FIGS. 3 and 4, the cartridge attachment section 110 includes the slider 170 and the coil spring 47 (an example of a biasing member). The slider 170 is supported by the first top wall 184 and the second top wall 185 such that the slider 170 can move along the first top wall 184 and second top wall 185. The coil spring 47 has one end connected to a projection 193 (see FIG. 11) formed on the end wall 181 above the protruding portion 189. The coil spring 47 has another end connected to a surface of the slider 170 facing the end wall 181 (i.e., front surface). With this structure, the coil spring 47 can apply a biasing force to the slider 170 in the removal direction 52.

<Slider 170>

Figure 5B:
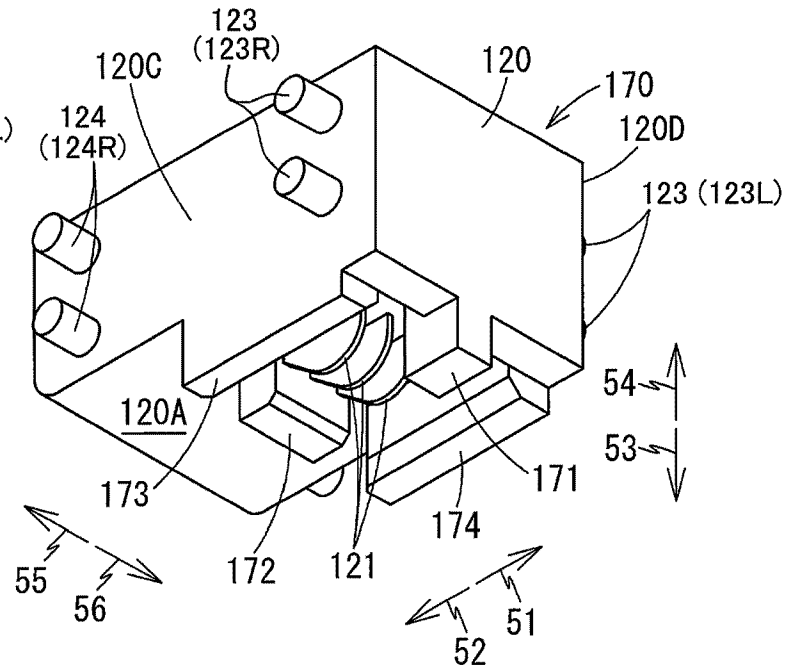
FIG. 5B is a perspective view illustrating a lower portion of the slider 170.
Figure 5A:
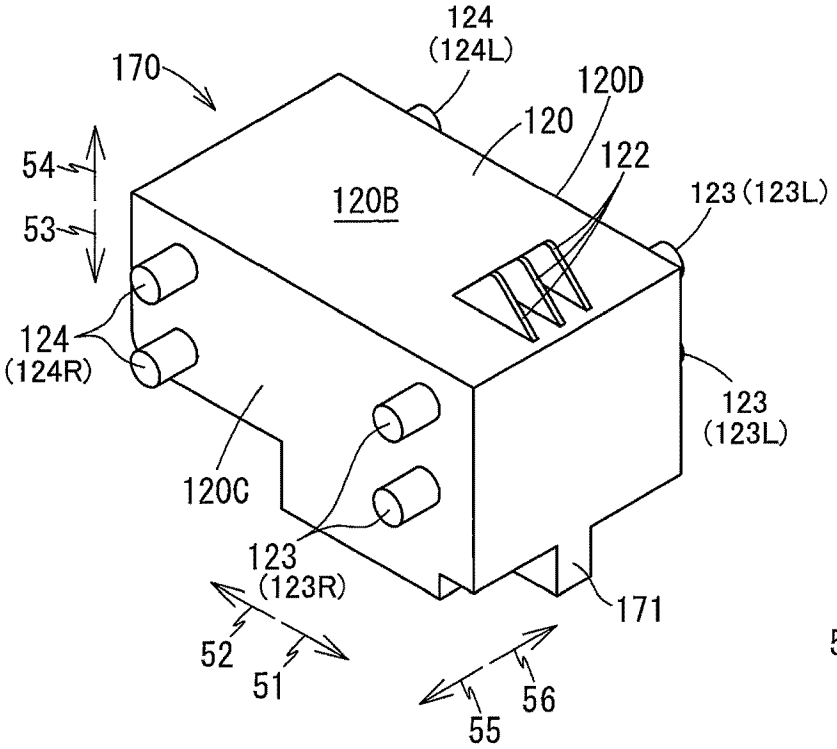
FIG. 5A is a perspective view illustrating an upper portion of a slider 170 of the cartridge attachment section 110.

As illustrated in FIGS. 4 through 5B, the slider 170 includes a body portion 120, three first contacts 121, three second contacts 122, four first guided portions 123, four second guided portions 124, the first wall 171, the second wall 172, the third wall 173, and the fourth wall 174.

The body portion 120 has a substantially rectangular parallelepiped shape. The body portion 120 is formed of an electrically insulating material (in the present embodiment, a resin). The body portion 120 has an inner space in which portions of the first and second contacts 121 and 122 are disposed. The body portion 120 includes a lower surface 120A, an upper surface 120B, a right surface 120C and a left surface 120D.

The three first contacts 121 are disposed at positions corresponding to the three electrodes 86, 87 and 88 on the IC board 85 of the ink cartridge 30. That is, the three first contacts 121 are aligned one another in the rightward direction 55 and the leftward direction 56. The three second contacts 122 are provided in correspondence with the three first contacts 121.

The first and second contacts 121 and 122 are formed of an electrically conductive material (in the present embodiment, made of a copper whose surface is plated with nickel and gold). Each of the first contacts 121 has a portion disposed in the inner space of the body portion 120, and a remaining portion protruding downward from the lower surface 120A of the body portion 120. Likewise, each of the second contacts 122 has a portion disposed in the inner space of the body portion 120, and a remaining portion protruding upward from the upper surface 120B of the body portion 120. The first and second contacts 121 and 122 may be integrally formed, or may be separate members. In case that the first and second contacts 121 and 122 are provided as separate members, the first and second contacts 121 and 122 are connected to each other within the body portion 120.

Although not illustrated in the drawings, the portions of the second contacts 122 protruding from the upper surface 120B are electrically connected to the controller 1 of the printer 10 by, for example, a flexible flat cable (FFC).

When the electrodes 86, 87 and 88 on the IC board 85 are made in contact with the first contacts 121, the IC board 85 can be electrically connected to the controller 1 via the second contacts 122. Thus, the controller 1 can access the IC 89A of the IC board 85 through the contact between the electrodes 86, 87 and 88 and the first contacts 121. The controller 1 is a control board provided in the printer 10 and includes a CPU, a ROM, and a RAM, for example.

Positions of the first contacts 121 can be changed depending on at which position the slider 170 is and in which posture the slider 170 takes. The positions of the first contacts 121 will be described later in greater detail.

The first guided portions 123 are four protrusions protruding either in the rightward direction 55 or in the leftward direction 56 from the right surface 120C of the body portion 120 or from the left surface 120D of the body portion 120. The four first guided portions 123 are arranged offset in the insertion direction 51 relative to the first contacts 121. That is, the first guided portions 123 are positioned downstream of the first contacts 121 in the insertion direction 51. More specifically, the first guided portions 123 are configured of two pairs of protrusions. One pair of the first guided portions 123 protrudes in the rightward direction 55 from the right surface 120C and is arranged spaced away from each other in the upward direction 54 and the downward direction 53 (referred to as "right first guided portion 123R" whenever necessary). The other pair of the first guided portions 123 protrudes in the leftward direction 56 from the left surface 120D and is arranged spaced away from each other in the upward direction 54 and the downward direction 53 (referred to as "left first guided portion 123L" whenever necessary). The upper one of the right first guided portions 123R and the upper one of the left first guided portions 123L are arranged to be on the same axis extending in the rightward direction 55 and leftward direction 56 (i.e., aligned each other in the rightward direction 55 and leftward direction 56). Similarly, the lower one of the right first guided portions 123R and the lower one of the left first guided portions 123L are arranged to be on the same axis extending in the rightward direction 55 and leftward direction 56 (i.e., aligned each other in the rightward direction 55 and leftward direction 56).

The second guided portions 124 are four protrusions protruding either in the rightward direction 55 or in the leftward direction 56 from the right surface 120C or from the left surface 120D of the body portion 120. The four second guided portions 124 are arranged offset in the removal direction 52 relative to the first contacts 121. That is, the second guided portions 124 are positioned downstream of the first contacts 121 in the removal direction 52. More specifically, the second guided portions 124 are configured of two pairs of protrusions. One pair of the second guided portions 124 protrudes in the rightward direction 55 from the right surface 120C and is arranged spaced away from each other in the upward direction 54 and the downward direction 53 (referred to as "right second guided portion 124R" whenever necessary). The other pair of the second guided portions 124 protrudes in the leftward direction 56 from the left surface 120D and is arranged spaced away from each other in the upward direction 54 and the downward direction 53 (referred to as "left second guided portion 124L" whenever necessary). The upper one of the right second guided portions 124R and the upper one of the left second guided portions 124L are arranged to be on the same axis extending in the rightward direction 55 and leftward direction 56 (i.e., aligned each other in the rightward direction 55 and leftward direction 56). The lower one of the right second guided portions 124R and the lower one of the left second guided portions 124L are arranged to be on the same axis extending in the rightward direction 55 and leftward direction 56 (i.e., aligned each other in the rightward direction 55 and leftward direction 56).

The first top wall 184 of the case 101 is inserted between the right first guided portions 123R and between the right second guided portions 124R. The second top wall 185 of the case 101 is inserted between the left first guided portions 123L and between the left second guided portions 124L. The slider 170 is thus supported by the first top wall 184 and second top wall 185 so as to be movable along the first top wall 184 and the second top wall 185.

The first wall 171, the second wall 172, the third wall 173, and the fourth wall 174 protrude respectively in the downward direction 53 from the lower surface 120A of the body portion 120. The first wall 171 protrudes further downward than the second wall 172, the third wall 173, and the fourth wall 174 in the downward direction 53.

The first wall 171 is positioned offset in the insertion direction 51 relative to the first contacts 121. That is, the first wall 171 is positioned downstream of the first contacts 121 in the insertion direction 51. When the first wall 171 is in contact with at least one of the IC board 85 and the board supporting portion 84 of the ink cartridge 30 inserted into and attached to the cartridge attachment section 110, a right end of the first wall 171 is positioned leftward of the right ends of the IC board 85 and the board supporting portion 84 of the ink cartridge 30, whereas a left end of the first wall 171 is positioned rightward of the left ends of the IC board 85 and the board supporting portion 84.

Further, when the first wall 171 is in contact with at least one of the IC board 85 and the board supporting portion 84 of the ink cartridge 30 inserted into and attached to the cartridge attachment section 110, the first wall 171 is positioned such that a lower end thereof is positioned lower than the upper ends of the IC board 85 and the board supporting portion 84 of the ink cartridge 30. That is, the first wall 171 has a portion that overlaps a moving trajectory of the IC board 85 and a portion of and board supporting portion 84 of the ink cartridge 30 that can be inserted into and removed from the cartridge attachment section 110. Here, this overlapping portion is the portion of the first wall 171 that is positioned below the upper ends of the IC board 85 and the board supporting portion 84 when the first wall 171 is in contact with at least one of the IC board 85 and the board supporting portion 84 of the ink cartridge 30 inserted into and attached to the cartridge attachment section 110. In the present embodiment, the "upper ends of the IC board 85 and the board supporting portion 84" mean the upper end of the IC board 85 and the upper end of the board supporting portion 84, whereas the "lower ends of the IC board 85 and the board supporting portion 84" mean the lower end of the IC board 85 and the lower end of the board supporting portion 84. The "right ends of the IC board 85 and the board supporting portion 84" mean the right end of the IC board 85 and the right end of the board supporting portion 84. The "left ends of the IC board 85 and the board supporting portion 84" mean the left end of the IC board 85 and the left end of the board supporting portion 84. The "ends of the IC board 85 and the board supporting portion 84 in the insertion direction 51" mean the end of the IC board 85 in the insertion direction 51 and the end of the board supporting portion 84 in the insertion direction 51. The "ends of the IC board 85 and the board supporting portion 84 in the removal direction 52" mean the end of the IC board 85 in the removal direction 52 and the end of the board supporting portion 84 in the removal direction 52.

The first wall 171 may be positioned at a different position from the above-described position, as long as the first wall 171 has the above-described overlapping portion. For example, when the first wall 171 is in contact with at least one of the IC board 85 and the board supporting portion 84 of the ink cartridge 30 inserted into and attached to the cartridge attachment section 110, the first wall 171 may be arranged such that: the right end of the first wall 171 is positioned rightward of the right ends of the IC board 85 and the board supporting portion 84; and the left end of the first wall 171 is positioned between the right and left ends of the IC board 85 and the board supporting portion 84. Alternatively, the left end of the first wall 171 may be positioned leftward of the left ends of the IC board 85 and the board supporting portion 84, while the right end of the first wall 171 may be positioned between the right and left ends of the IC board 85 and the board supporting portion 84. Still alternatively, the right end of the first wall 171 may be positioned rightward than of the right ends of the IC board 85 and the board supporting portion 84, while the left end of the first wall 171 may be positioned leftward of the left ends of the IC board 85 and the board supporting portion 84.

The second wall 172 is arranged offset in the removal direction 52 relative to the first contacts 121. That is, the second wall 172 is positioned downstream of the first contacts 121 in the removal direction 52. When the first wall 171 is in contact with at least one of the IC board 85 and the board supporting portion 84 of the ink cartridge 30 inserted into and attached to the cartridge attachment section 110, a right end of the second wall 172 is positioned rightward of the right ends of the IC board 85 and the board supporting portion 84. A left end of the second wall 172 is positioned leftward of the left ends of the IC board 85 and the board supporting portion 84, when the first wall 171 is in contact with at least one of the IC board 85 and the board supporting portion 84 of the ink cartridge 30 inserted into and attached to the cartridge attachment section 110.

The position of the second wall 172 in the downward direction 53 and upward direction 54 can vary depending on the position and posture of the slider 170. The position of the second wall 172 in the downward direction 53 and upward direction 54 will be described later in greater detail.

The third wall 173 is provided rightward of the first contacts 121. In other words, the third wall 173 is positioned offset in the rightward direction 55 relative to the first contacts 121. The third wall 173 has one end in the insertion direction 51 (front end) that is positioned offset in the insertion direction 51 relative to the end of the IC board 85 in the insertion direction 51 (front end) of the ink cartridge 30 that has been completely attached to the cartridge attachment section 110. That is, the front end of the third wall 173 is positioned downstream of the front end of the IC board 85 in the insertion direction 51. The third wall 173 has another end in the removal direction 52 (rear end) that is positioned offset in the removal direction 52 relative to the end of the IC board 85 in the removal direction 52 (rear end) of the ink cartridge 30 that has been completely attached to the cartridge attachment section 110. That is, the rear end of the third wall 173 is positioned downstream of the rear end of the IC board 85 in the removal direction 52.

The third wall 173 has a lower end that is positioned further downward relative to the upper end of the IC board 85 of the ink cartridge 30 completely attached to the cartridge attachment section 110. That is, the third wall 173 has a portion that overlaps the IC board 85 of the ink cartridge 30 completely attached to the cartridge attachment section 110 when viewed in the rightward direction 55. Here, in the present embodiment, this overlapping portion is a portion of the third wall 173 that is positioned below the upper end of the IC board 85 of the ink cartridge 30 completely attached to the cartridge attachment section 110, and between both ends of the IC board 85 in the insertion direction 51 and the removal direction 52 (front and rear ends of the IC board 85).

The third wall 173 may be arranged at a different position from the above-described position when the ink cartridge 30 is completely attached to the cartridge attachment section 110, as long as the third wall 173 has the overlapping portion. For example, the end of the third wall 173 in the insertion direction 51 (front end) may be positioned offset in the insertion direction 51 relative to the end of the IC board 85 in the insertion direction 51, while the end of the third wall 173 in the removal direction 52 (rear end) may be positioned between both ends of the IC board 85 in the insertion direction 51 and the removal direction 52. Alternatively, the end of the third wall 173 in the removal direction 52 (rear end) may be arranged offset in the removal direction 52 relative to the end of the IC board 85 in the removal direction 52, while the end of the third wall 173 in the insertion direction 51 (front end) may be positioned between both ends of the IC board 85 in the insertion direction 51 and the removal direction 52. Still alternatively, both ends of the third wall 173 in the insertion direction 51 and the removal direction 52 (front and rear ends) may be positioned between both ends of the IC board 85 in the insertion direction 51 and the removal direction 52.

The fourth wall 174 is disposed leftward of the first contacts 121. That is, the fourth wall 174 is disposed offset in the leftward direction 56 relative to the first contacts 121. The fourth wall 174 has a portion that overlaps the IC board 85 of the ink cartridge 30 completely attached to the cartridge attachment section 110 when seen in the leftward direction 56. Here, the overlapping portion is a portion of the fourth wall 174 that is positioned below the upper end of the IC board 85 of the ink cartridge 30 completely attached to the cartridge attachment section 110 and between both ends of the IC board 85 in the insertion direction 51 and the removal direction 52. The position and structure of the fourth wall 174 are the same as those of the third wall 173, and the detailed description therefor is omitted here.

Figure 6:
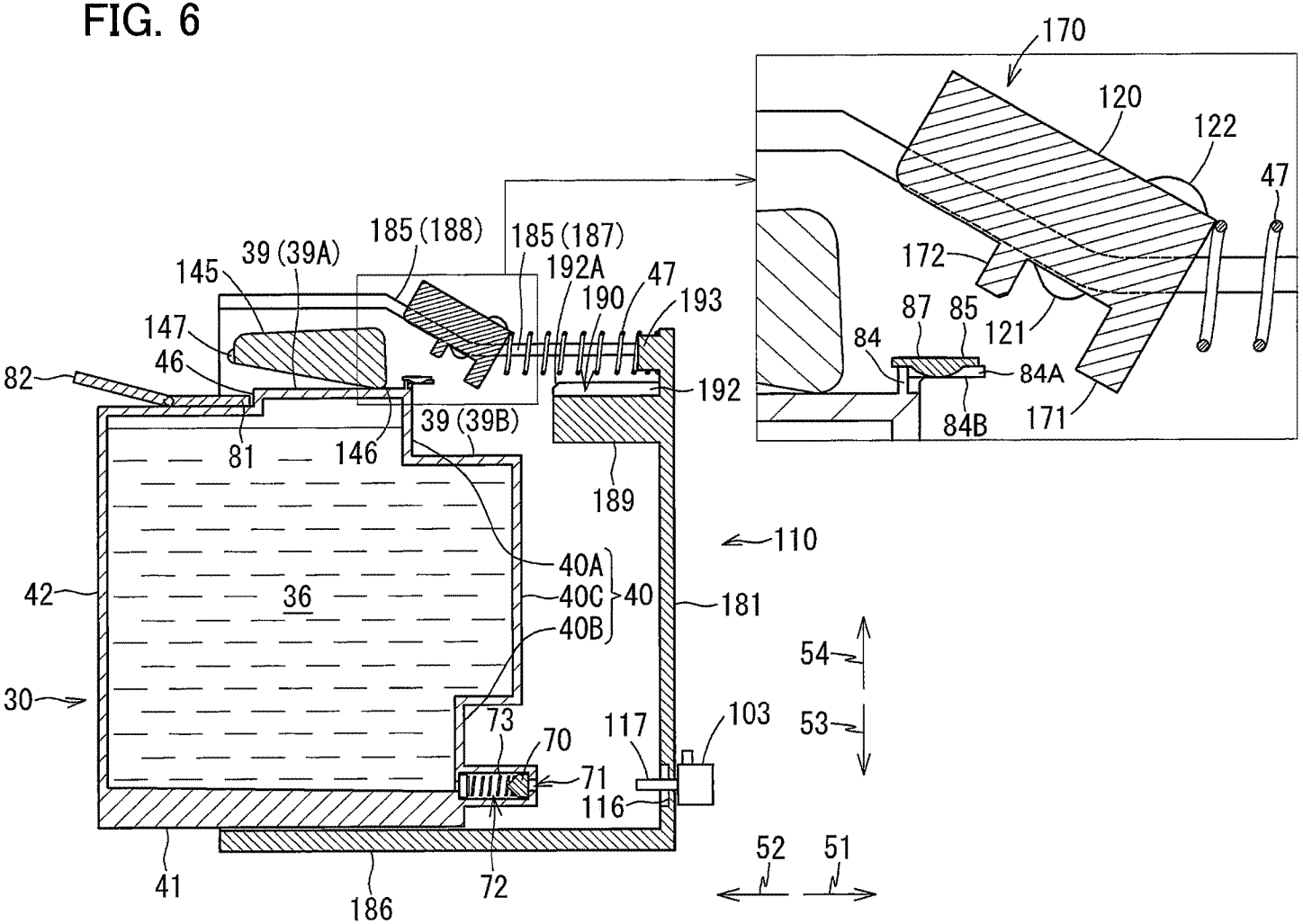
FIG. 6 is a cross-sectional view of the ink cartridge 30 and the cartridge attachment section 110, wherein the ink cartridge 30 is being inserted into the cartridge attachment section 110 for attachment.

The slider 170 can move between the first position (illustrated in FIGS. 9 and 10B) and a second position (illustrated in FIGS. 3 and 6). Further, the slider 170 can also change its posture between the first posture (illustrated in FIGS. 9 to 10B) and a second posture (illustrated in FIGS. 3 and 6). In other words, the slider 170 is in the first posture when the slider 170 is at the first position, whereas the slider 170 is in the second posture when the slider 170 is at the second position.

The second position is a position offset (displaced) in the removal direction 52 relative to the first position. When the slider 170 is in the first posture, the upper surface 120B of the body portion 120 of the slider 170 is parallel to the insertion direction 51. When the slider 170 is in the second posture, the end of the upper surface 120B of the body portion 120 of the slider 170 in the removal direction 52 (rear end) is positioned higher (upward) than the end of the upper surface 120B in the insertion direction 51 (front end).

Figure 10B:
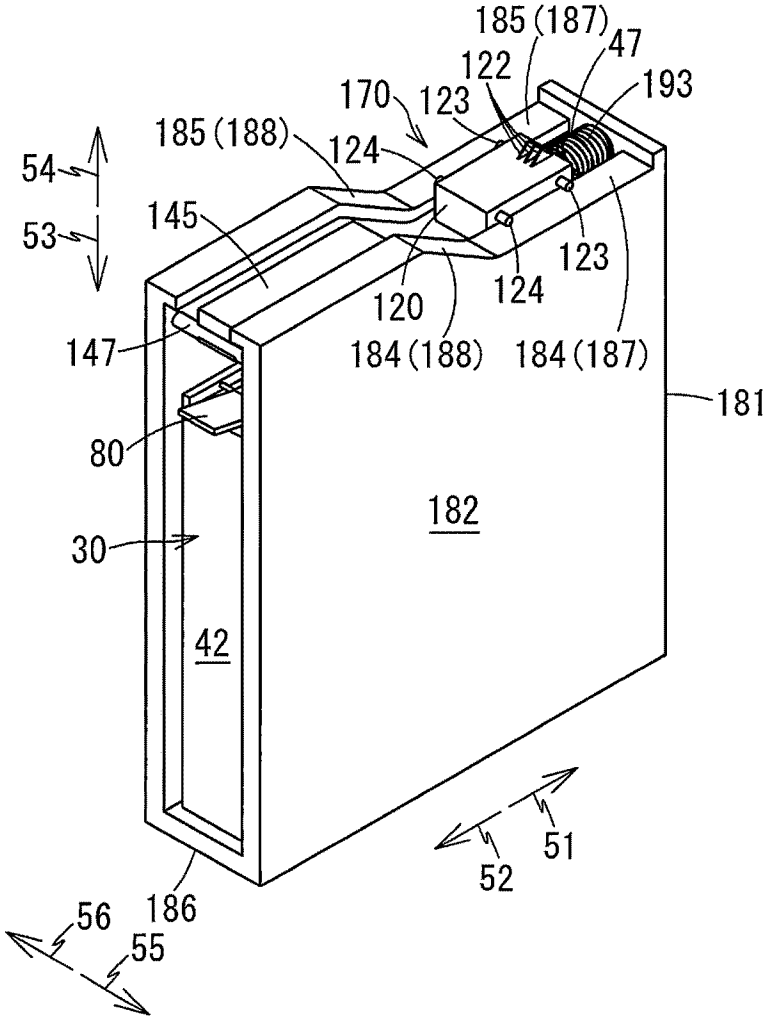
FIG. 10B is a perspective view illustrating the ink cartridge 30 and the cartridge attachment section 110, wherein the slider 170 is at the first position.

As illustrated in FIG. 10B, when the slider 170 is at the first position and in the first posture, the first guided portions 123 and the second guided portions 124 are supported by the first guide part 187 constituting the first top wall 184 and the first guide part 187 constituting the second top wall 185. More specifically, the upper one of the right first guided portions 123R and the upper one of the left first guided portions 123L are respectively supported by the right first guide part 187R of the first top wall 184 and the left first guide part 187L of the second top wall 185 from below, while the upper one of the right second guided portions 124R and the upper one of the left second guided portions 124L are respectively supported by the right first guide part 187R of the first top wall 184 and the left first guide part 187L of the second top wall 185 from below. As illustrated in FIG. 3, when the slider 170 is at the second position and in the second posture, the first guided portions 123 are supported by the first guide part 187 constituting the first top wall 184 and the first guide part 187 constituting the second top wall 185, while the second guided portions 124 are supported by the second guide part 188 constituting the first top wall 184 and the second guide part 188 constituting the second top wall 185. More specifically, the upper one of the right first guided portions 123R and the upper one of the left first guided portions 123L are supported respectively by the right first guide part 187R of the first top wall 184 and the left first guide part 187L of the second top wall 185 from below, whereas the upper one of the right second guided portion 124R and the upper one of the left second guided portions 124L are supported respectively by the right second guide part 188R of the first top wall 184 and the left second guide part 188L of the second top wall 185 from below.

Figure 8:
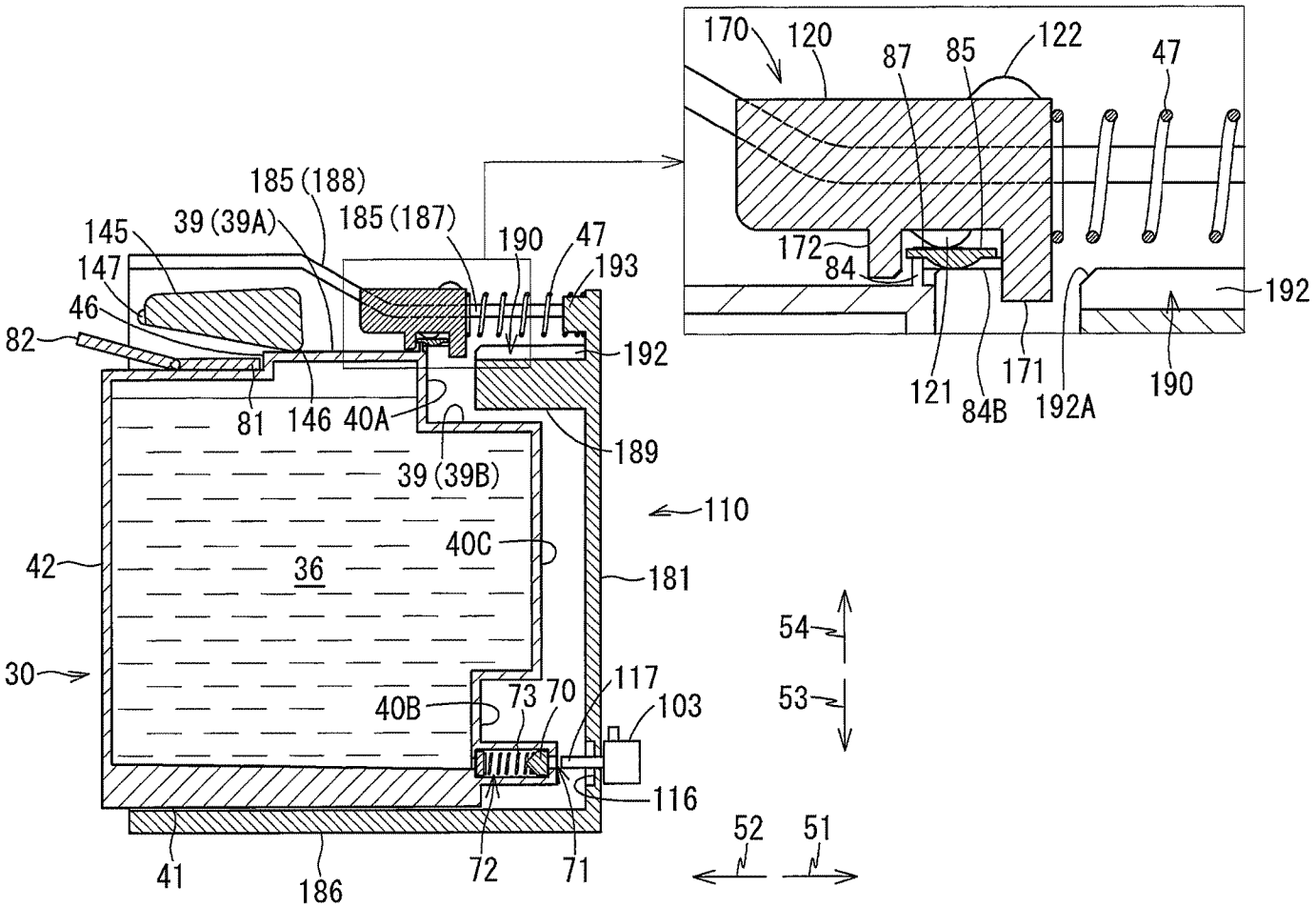
FIG. 8 is a cross-sectional view of the ink cartridge 30 and the cartridge attachment section 110, wherein the ink cartridge 30 has been inserted into the cartridge attachment section 110 until the slider 170 is at the intermediate position.
Figure 10A:
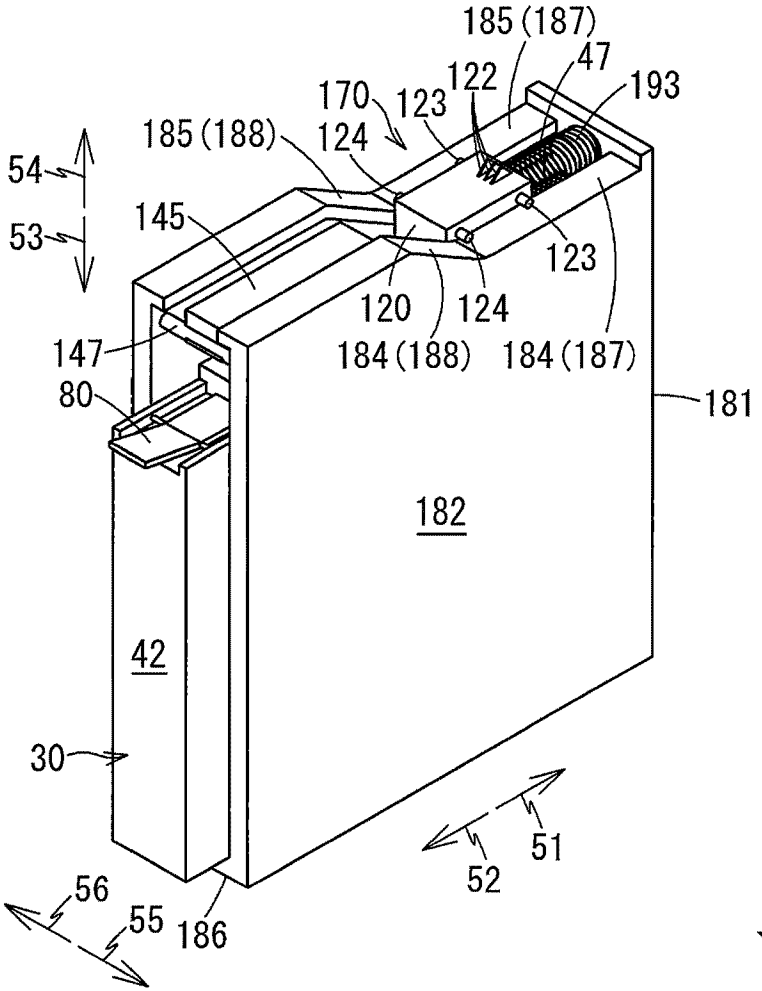
FIG. 10A is a perspective view illustrating the ink cartridge 30 and the cartridge attachment section 110, wherein the slider 170 is at the intermediate position.

The slider 170 is also movable to an intermediate position between the first position and the second position, as shown in FIGS. 8 and 10A. When the slider 170 is at the intermediate position, similarly at the first position, the first guided portions 123 and the second guided portions 124 are supported by the first guide parts 187 of the first top wall 184 and second top wall 185. At the intermediate position, the slider 170 is therefore in the first posture. That is, the slider 170 moves between the first position and the intermediate position while maintaining the first posture. On the other hand, when the slider 17 moves from the intermediate position toward the second position, the second guided portions 124 are displaced from the first guide parts 187 toward the second guide parts 188 and are supported by the second guide parts 188. In this way, the slider 170 starts changing its posture from the first posture to the second posture when moving from the intermediate position toward the second position. When the slider 170 finally reaches the second position, the slider 170 takes the second posture.

In accordance with movement of the slider 170, the first contacts 121 can move between a contact position (illustrated in FIG. 9) and a non-contact position (illustrated in FIG. 6). That is, the first contacts 121 are at the contact position when the slider 170 is at the first position and in the first posture, while the first contacts 121 are at the non-contact position when the slider 170 is at the second position and in the second posture.

Each of the three first contacts 121 at the contact position is in pressure contact with, from above, corresponding one of the electrodes 86, 87 and 88 of the ink cartridge 30 completely attached to the cartridge attachment section 110. At the same time, due to reaction force applied from the electrodes 86, 87 and 88, the first contacts 121 are resiliently deformed upward. That is, the first contacts 121 at the contact position overlap the electrodes 86, 87 and 88 of the ink cartridge 30 completely attached to the cartridge attachment section 110.

The non-contact position is higher than the contact position. That is, the non-contact position is separated in the upward direction 54 away from the contact position. The three first contacts 121 at the non-contact position are positioned higher than upper ends of the electrodes 86, 87 and 88 of the ink cartridge 30. That is, the first contacts 121 at the non-contact position are separated away from the corresponding electrodes 86, 87 and 88.

When the slider 170 is at the first position and in the first posture, the lower end of the second wall 172 is positioned lower than the upper ends of the IC board 85 and the board supporting portion 84 of the ink cartridge 30 (see FIG. 9).

When the slider 170 is at the second position and in the second posture, the lower end of the second wall 172 is positioned higher than the upper ends of the IC board 85 and the board supporting portion 84 of the ink cartridge 30 (see FIG. 6). That is, the second wall 172 is positioned offset in the upward direction 54 (displaced upward) from the moving trajectory of the IC board 85 and the portion of and the board supporting portion 84 of the ink cartridge 30 inserted into and removed from the cartridge attachment section 110.

In other words, while the slider 170 moves from the first position to the second position, the second wall 172 changes its posture, from a state where the lower end thereof is positioned lower than the upper ends of the IC board 85 and the board supporting portion 84, to a state where the lower end is positioned higher than the upper ends of the IC board 85 and the board supporting portion 84.

Further, as described above, the right end of the second wall 172 is positioned rightward of the right ends of the IC board 85 and the board supporting portion 84, and the left end of the second wall 172 is positioned leftward of the left ends of the IC board 85 and the board supporting portion 84.

Thus, the second wall 172 has a portion that overlaps the moving trajectory of the IC board 85 and the portion of the board supporting portion 84 of the ink cartridge 30 inserted into and removed from the cartridge attachment section 110. Here, in the present embodiment, the overlapping portion is a portion of the second wall 172 that is positioned lower than the upper ends of the IC board 85 and the board supporting portion 84.

The second wall 172 may be arranged at a different position from the above-described position, as long as the second wall 172 has the overlapping portion. For example, when the first wall 171 is in contact with at least one of the IC board 85 and the board supporting portion 84 of the ink cartridge 30 inserted and attached to the cartridge attachment section 110, the right end of the second wall 172 may be rightward of the right ends of the IC board 85 and the board supporting portion 84, while the left end of the second wall 172 may be positioned between the right and left ends of the IC board 85 and the board supporting portion 84. Alternatively, the left end of the second wall 172 may be positioned leftward of the left ends of the IC board 85 and the board supporting portion 84, while the right end of the second wall 172 may be positioned between the right and left ends of the IC board 85 and the board supporting portion 84. Still alternatively, both the right and left ends of the second wall 172 may be positioned between the right and left ends of the IC board 85 and the board supporting portion 84.

<Attachment and Detachment of the Ink Cartridge 30>

Hereinafter, how the ink cartridge 30 is attached to and detached from the cartridge attachment section 110 will be described mainly with reference to FIGS. 6 through 9.

As illustrated in FIG. 6, when the ink cartridge 30 is inserted into the cartridge attachment section 110 in the insertion direction 51, the first top wall 39A of the main body 31 causes the engagement member 145 to pivot in the upward direction 54, thereby moving the engagement member 145 from the lock position to the unlock position. At this time, the slider 170 is at the second position and in the second posture. Thus, the first contacts 121 are at the non-contact position.

When the ink cartridge 30 is inserted further in the insertion direction 51, the extension end 84A of the board supporting portion 84 is brought into contact with the first wall 171 of the slider 170 to press the first wall 171 in the insertion direction 51. At this time, the first wall 171 is inserted into the gap between the two convex portions 90.

Figure 7:
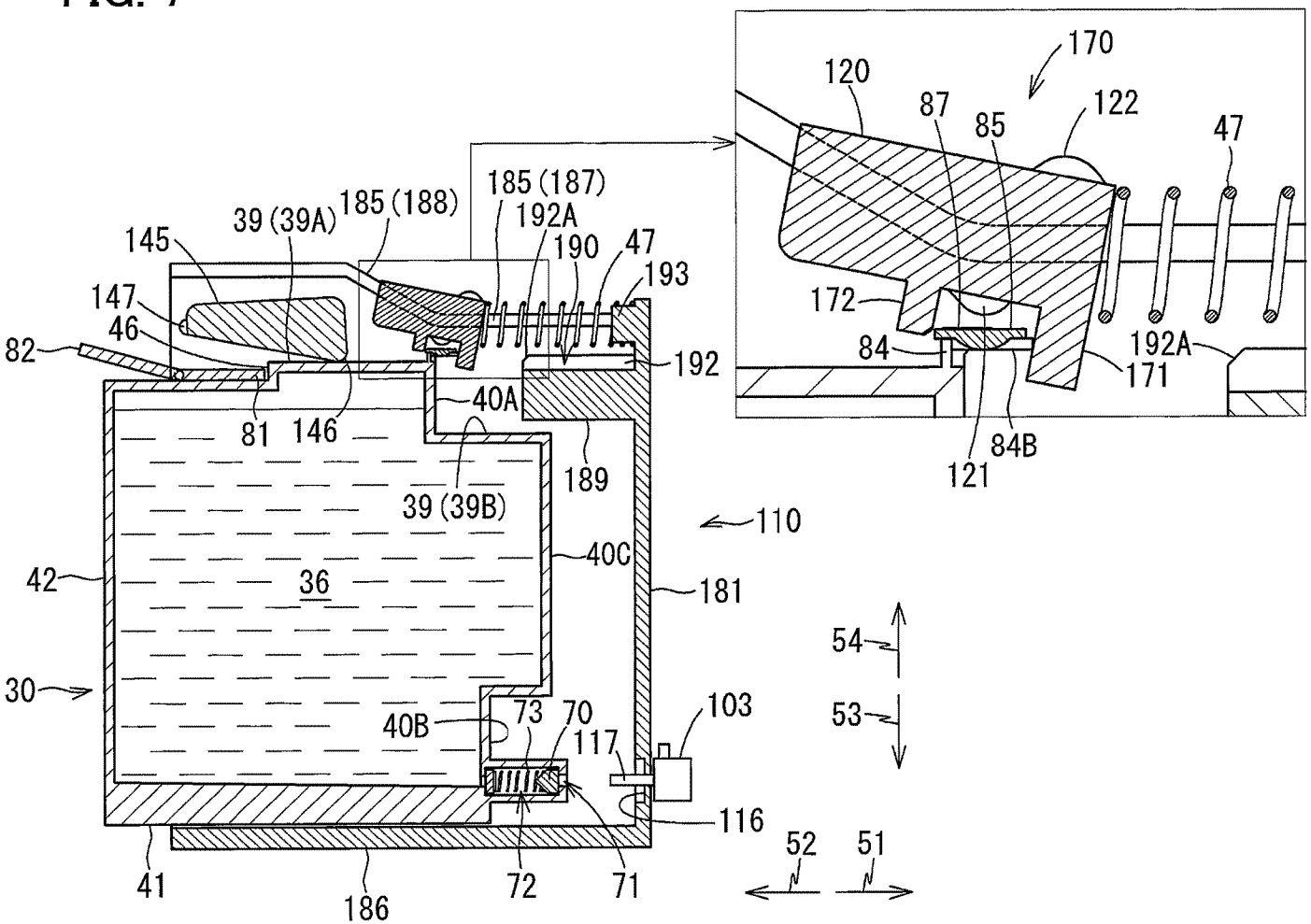
FIG. 7 is a cross-sectional view of the ink cartridge 30 and the cartridge attachment section 110, wherein the ink cartridge 30 has been inserted into the cartridge attachment section 110 until the slider 170 is positioned between a second position and an intermediate position.

As the extension end 84A presses the first wall 171 in the insertion direction 51, the slider 170 is moved from the second position toward the first position along the first top wall 184 and second top wall 185 against the biasing force of the coil spring 47 (see FIG. 7). In the meantime, the second guided portions 124 are moved downward along the slope of the second guide parts 188. As a result, the slider 170 starts changing its posture from the second posture to the first posture. The first contacts 121 also start moving from the non-contact position toward the contact position.

When the ink cartridge 30 is inserted further in the insertion direction 51 from the state shown in FIG. 7, the second guided portions 124 are moved from the second guide parts 188 onto the first guide parts 187 and are supported by the first guide parts 187. That is, the slider 170 reaches the intermediate position (shown in FIG. 8). At this time, the slider 170 takes the first posture. The first contacts 121 are now at the contact position and thus in contact with the corresponding electrodes 86, 87 and 88. Further, at this time, the lower ends of the second wall 172, third wall 173 and fourth wall 174 are positioned lower than the upper ends of the IC board 85 and the board supporting portion 84. That is, the IC board 85 and the board supporting portion 84 are positioned between the first wall 171 and the second wall 172 in the insertion direction 51 and removal direction 52, and between the third wall 173 and the fourth wall 174 in the rightward direction 55 and leftward direction 56.

When the ink cartridge 30 is inserted further in the insertion direction 51 from the state shown in FIG. 8, the slider 170 moves toward the first position while maintaining the first posture.

At this time, while moving in the insertion direction 51, the first wall 171 enters into the groove 190 between the first protruding part 191 and the second protruding part 192 of the protruding portion 189. In the meantime, the board supporting portion 84 is brought into contact with the inclined surfaces 191A and 192A formed on the ends of the first protruding part 191 and second protruding part 192 in the removal direction 52. The board supporting portion 84 is guided by and along the inclined surfaces 191A and 192A to ride onto the first protruding part 191 and second protruding part 192. In this way, the board supporting portion 84 is supported by the protruding portion 189.

The ink cartridge 30 further inserted in the insertion direction 51 then reaches the first position (see FIG. 9). At this time, as in the state shown in FIG. 8, the first contacts 121 are in contact with the corresponding electrodes 86, 87 and 88, and the IC board 85 and the board supporting portion 84 are positioned between the first wall 171 and the second wall 172 in the insertion direction 51 and the removal direction 52, as well as between the third wall 173 and the fourth wall 174 in the rightward direction 55 and the leftward direction 56. Further, at this time, the first wall 171 is disposed in the first space 161, the second wall 172 is disposed in the second space 162, the third wall 173 is disposed in the third space 163, and the fourth wall 174 is disposed in the fourth space 164.

Further, as the ink cartridge 30 is inserted further in the insertion direction 51 from the state shown in FIG. 8, the ink supply portion 34 is brought into contact with the retention groove 116. Thus, as illustrated in FIG. 9, the ink needle 117 is inserted into the ink supply opening 71 of the ink supply portion 34. The ink supply valve 70 is pressed by the ink needle 117 and is separated away from the ink supply opening 71 against the biasing force of the coil spring 73.

Further, the engagement member 145 moves onto the locking portion 45 from the first top wall 39A of the main body 31 of the ink cartridge 30. Since the engagement member 145 is no longer supported by the top wall 39, the engagement member 145 is caused to pivot in the downward direction 53 to be at the lock position. At this time, the engagement end 146 and the locking surface 46 face each other in the insertion direction 51 and the removal direction 52.

When the force pressing the ink cartridge 30 in the insertion direction 51 disappears from this state (when the user releases his hand from the ink cartridge 30), the ink cartridge 30 is caused to retract in the removal direction 52 due to the biasing force of the coil spring 47 and coil spring 73 until the engagement end 146 and the locking surface 46 make contact with each other. With this structure, the engagement member 145 can maintain the ink cartridge 30 retained in the cartridge attachment section 110 against the force pressing the ink cartridge 30 in the removal direction 52 (i.e., the biasing force of the coil springs 47 and 73). At this time, as show in FIG. 9, the tip end portion 81 of the pivot member 80 is positioned below the engagement member 145. The rear end portion 82 of the pivot member 80 is separated from the bottom surface of the groove constituting the locking portion 45 to be positioned higher than the top wall 39 of the main body 31. In this way, attachment of the ink cartridge 30 to the cartridge attachment section 110 is complete.

When the ink cartridge 30 is in the attached state as illustrated in FIG. 9, the ink needle 117 keeps the ink supply valve 70 away from the ink supply opening 71. Hence, ink can flow out from the ink chamber 36 through an ink inlet (not illustrated) formed in the distal end of the ink needle 117. Further, the electrodes 86, 87 and 88 are in contact with the first contacts 121, thereby establishing electrical connection between the IC 89A of the IC board 85 and the controller 1 of the printer 10. The controller 1 is thus accessible to the IC 89A of the IC board 85 through the electrical connection therebetween.

For removing the ink cartridge 30 from the cartridge attachment section 110, the user needs to press the rear end portion 82 of the pivot member 80 in the downward direction 53. The tip end portion 81 of the pivot member 80 in turn moves in the upward direction 54 to be separated away from the bottom surface of the groove constituting the locking portion 45. In accordance with this upward movement of the tip end portion 81, the engagement member 145 at the lock position is caused to pivot in the upward direction 54 to move to the unlock position. When the engagement member 145 is at the unlock position, the engagement member 145 no longer retains the ink cartridge 30 in the cartridge attachment section 110.

When the engagement member 145 has moved to the unlock position, the slider 170 is caused to move in the removal direction 52 by the biasing force of the coil spring 47. That is, the slider 170 starts moving from the first position toward the second position. As a result, the first wall 171 of the slider 170, which is in contact with the extension end 84A of the board supporting portion 84, presses the extension end 84A in the insertion direction to move the ink cartridge 30 in the removal direction 52 by the biasing force of the coil spring 47. In the present embodiment, the biasing force of the coil spring 73 also contributes to the movement of the ink cartridge 30 in the removal direction 52.

When the ink cartridge 30 is moved in the removal direction 52, the ink needle 117 is removed from the ink supply portion 34. As a result, the ink supply valve 70 is pushed toward the ink supply opening 71 by a restoring force (biasing force) of the coil spring 73 to close the ink supply opening 71.

When the ink cartridge 30 and the slider 170 are moved in the removal direction 52, the slider 170 changes its posture from the first posture to the second posture. The first contacts 121 are thus moved in the upward direction 54 from the contact position to the non-contact position, and separated away from the corresponding electrodes 86, 87 and 88. The electrical connection between the IC 89A of the IC board 85 and the controller 1 of the printer 10 is therefore disconnected.

The slider 170 can change its posture from the first posture to the second posture as the slider 170 moves in the removal direction 52. This means that the second wall 172 of the slider 170 does not interfere with the movement of the board supporting portion 84 and the IC board 85 of the ink cartridge 30.

<Operational and Technical Advantages>

In the present embodiment, when inserted into the cartridge attachment section 110, the ink cartridge 30 is brought into contact with the first wall 171 of the slider 170 at the second position and in the second posture, moving the slider 170 to the first position against the biasing force of the coil spring 47. The slider 170 changes its posture to the first posture when displaced to the first position. When the ink cartridge 30 is completely attached to the cartridge attachment section 110, the first wall 171 is accommodated in the first space 161, and the second wall 172 of the slider 170 in the first posture is accommodated in the second space 162. In other words, the IC board 85 of the completely attached ink cartridge 30 is disposed between the first wall 171 and the second wall 172 of the slider 170 at the first position and in the first posture in the insertion direction 51 and the removal direction 52. Hence, the electrodes 86, 87 and 88 on the IC board 85 can make contact with the first contacts 121 that has been moved to the contact position by the slider 170 in the first posture. Further, when the ink cartridge 30 is removed from the cartridge attachment section 110, the slider 170 is moved from the first position to the second position by the biasing force of the coil spring 47 and changes its posture from the first posture to the second posture.

Figure 12:
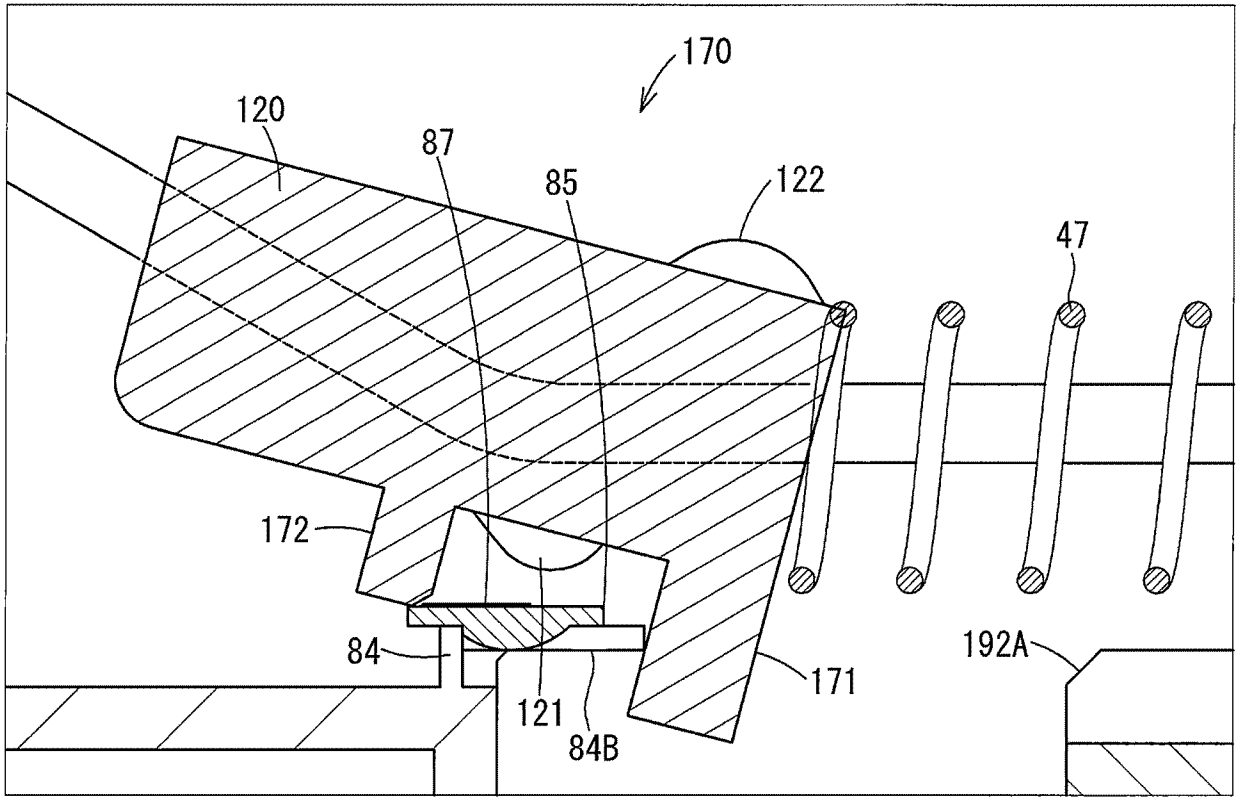
FIG. 12 is a cross-sectional view illustrating a hypothetical state of the ink cartridge 30 and the cartridge attachment section 110 as a comparative example, wherein the ink cartridge 30 assumed to have an IC board 85 positioned offset in a removal direction 52 relative to a board supporting portion 84 is being attached to the cartridge attachment section 110.

If the IC board 85 were arranged offset in the insertion direction 51 relative to the board supporting portion 84, it is likely that the IC board 85 would collide against the first wall 171 and the board supporting portion 84 would protrude into the second space 162 to inhibit the slider 170 from changing into the first posture. Similarly, if the IC board 85 were disposed offset in the removal direction 52 relative to the board supporting portion 84, it is likely that the board supporting portion 84 would abut against the first wall 171 and the IC board 85 protrudes into the second space 162 to inhibit the slider 170 from changing into the first posture, as shown in FIG. 12. If the slider 170 is prohibited from changing into the first posture, the first contacts 121 cannot make contact with the electrodes 86, 87 and 88. That is, with the structure of the present embodiment, the electrodes 86, 87 and 88 of the IC board 85 can make contact with the first contacts 121 only if the IC board 85 is supported by the board supporting portion 84 at the correct position. Put another way, the electrodes 86, 87 and 88 of the IC board 85 cannot contact the first contacts 121 if the IC board 85 is supported by the board supporting portion 84 such that the IC board 85 is positioned offset in the insertion direction 51 or in the removal direction 52 relative to board supporting portion 84. The structure of the present embodiment can ensure a stable electrical contact between the electrodes 86, 87 and 88 and the first contacts 121.

It should be noted that "the ink cartridge 30 is completely attached to the cartridge attachment section 110" means a state where the recording head 21 can consume the ink stored in the ink cartridge 30, for example. Further, in the course of insertion and removal of the ink cartridge 30 relative to the cartridge attachment section 110, the IC board 85, or the board supporting portion 84, or any other component of the ink cartridge 30 may make contact with the first wall 171.

Further, according to the structure of the present embodiment, when the locking by the engagement member 145 is released, removal of the ink cartridge 30 is assisted by the biasing force in the removal direction 52. If the point of contact between the engagement member 145 and the locking surface 46 were to be displaced in the removal direction 52 due to aging of the case 101, engagement member 145 or the support shaft 147, for example, conceivably, the ink cartridge 30 completely attached to the cartridge attachment section 110 could be accidentally displaced in the removal direction 52. Even in this case, according to the structure of the present embodiment, the slider 170 would move to follow the movement of the ink cartridge 30 in the removal direction 52. Since the slider 170 is maintained in the first posture while moving between the first position and the intermediate position, stable electrical contact can be maintained between the electrodes 86, 87 and 88 and the first contacts 121.

Note that the "biasing force acting on the ink cartridge 30 in the removal direction 52" may be the biasing force of the coil spring 47 acting on the ink cartridge 30 via the slider 170, or the biasing force of the coil spring 73 for moving the ink supply valve 70 to close the ink supply opening 71 of the ink supply portion 34 of the ink cartridge 30, for example.

Further, according to the structure of the present embodiment, if the IC board 85 were supported by the board supporting portion 84 at a position offset in the rightward direction 55 relative to the board supporting portion 84, the IC board 85 would abut against the third wall 173 of the slider 170, thereby preventing insertion of the ink cartridge 30 into the cartridge attachment section 110. Likewise, if the IC board 85 were supported by the board supporting portion 84 at a position offset in the leftward direction 56 relative to the board supporting portion 84, the IC board 85 would abut against the fourth wall 174, thereby hindering insertion of the ink cartridge 30 into the cartridge attachment section 110. Hence, the electrodes 86, 87 and 88 mounted on the IC board 85 can make contact with the first contacts 121 only when the IC board 85 is supported by the board supporting portion 84 at the correct position. If the IC board 85 were supported by the board supporting portion 84 at a position offset in the rightward direction 55 or in the leftward direction 56 relative to the board supporting portion 84, the electrodes 86, 87 and 88 on the IC board 85 could not be brought into contact with the first contacts 121. The structure of the present embodiment can thus realize stable electrical contact between the electrodes 86, 87 and 88 and the corresponding first contacts 121.

Further, since the board supporting portion 84 protrudes further in the insertion direction 51 relative to the IC board 85, the IC board 85 can be prevented from colliding against the first wall 171, for example, if the ink cartridge 30 were inserted rigorously into the cartridge attachment section 110. The IC board 85 can be suppressed from getting peeled off the board supporting portion 84.

Further, if the IC board 85 of the ink cartridge 30 inserted into the cartridge attachment section 110 were supported by the board supporting portion 84 such that the IC board 85 is offset in the insertion direction 51 or in the removal direction 52 relative to the board supporting portion 84, the second guided portions 124 cannot move from the second guide parts 188 onto the first guide parts 187. As a result, the slider 170 cannot move into the first position. In the example shown in FIG. 12, the slider 170 cannot move in the insertion direction 51 from the position illustrated in FIG. 12. If the slider 170 cannot move into the first position, the ink cartridge 30 cannot be inserted up to the position (shown in FIG. 9) where the ink cartridge 30 is completely attached to the cartridge attachment section 110. Thus, when the IC board 85 were arranged offset in the insertion direction 51 or in the removal direction 52 relative to the board supporting portion 84 and supported by the board supporting portion 84, this structure of the depicted embodiment can help the user to realize that there is something wrong with the ink cartridge 30 he is trying to insert.

Further, the protruding portion 189 provided on the cartridge attachment section 110 can restrict the IC board 85 in pressure contact with the first contacts 121 from being displaced in the downward direction 53 (i.e., in a direction away from the first contacts 121). Thus, further stable electrical contact between the electrodes 86, 87 and 88 and the first contacts 121 can be achieved.

Further, the first protruding part 191 and second protruding part 192 interpose the first wall 171 of the slider 170 therebetween to restrict the slider 170 from moving in the rightward direction 55 and the leftward direction 56. Thus, further stable electrical contact can be realized between the electrodes 86, 87 and 88 and the first contacts 121.

Further, the inclined surfaces 191A and 192A serve to guide the movement of the IC board 85 onto the first protruding part 191 and second protruding part 192, respectively, during insertion of the ink cartridge 30 into the cartridge attachment section 110. The insertion of the ink cartridge 30 into the cartridge attachment section 110 can be guided smoothly by the inclined surfaces 191A and 192A.

Further, in the present embodiment, the first wall 171 of the slider 170 can contact the board supporting portion 84 at a different position from the convex portions 190. This means that the first wall 171 and the board supporting portion 84 can contact each other at a position closer to the electrodes 86, 87 and 88 than otherwise. With this structure, the electrodes 86, 87 and 88 of the ink cartridge 30 whose the IC board 85 is supported offset (displaced) in the insertion direction 51 or the removal direction 52 relative to the board supporting portion 84 can be effectively prevented from being brought into contact with the first contacts 121.

The controller 1 of the embodiment can access to the IC 89A of the ink cartridge 30 through the electrodes 86, 87 and 88 and the first contacts 121 that are stably in contact with each other. Here, "access" means one of, or both of retrieving information from the IC 89A and writing information to the IC 89A, for example.

<Modifications and Variations>

In the depicted embodiment, the slider 170 maintains the first posture while moving between the intermediate position and the first position. However, the slider 170 may move differently. For example, the slider 170 may not change into the first posture while moving from the second position to the first position, but may take the first posture immediately upon reaching the first position. In order to realize such movement of the slider 170, for example, the first top wall 184 and second top wall 185 may be configured only of the second guide parts 188, without the first guide parts 187.

In the depicted embodiment, the slider 170 can change its posture between the first posture and the second posture and move between the first position and the second position by providing the first guide parts 187 and second guide parts 188 on the case 101 and the first guided portions 123 and second guided portions 124 on the slider 170. However, a different structure may also be conceivable as long as the same change in the posture of the slider 170 and the same movement of the slider 170 can be realized.

In the above-described embodiment, the printer 10 configured to record images on recording sheets based on the so-called inkjet recording scheme is employed as an example of the system of the invention. However, the system of the invention may be embodied as a printer configured to record images on recording sheets based on another scheme, such as an electrophotographic scheme, or as a label printer configured to record images on labels based on a thermal transfer printing scheme.

In the embodiment, ink is employed as an example of the consumable material of the invention. However, instead of liquid such as ink, the consumable material of the invention may be powder such as toner, or a tape used in a label printer.

While the invention has been described in detail with reference to the specific embodiment thereof, it would be apparent to those skilled in the art that various changes and modifications may be made therein without departing from the scope of the invention.

What is claimed is:

1. A system comprising:

a cartridge configured to accommodate a consumable material;

a cartridge attachment section, the cartridge being inserted into and attached to the cartridge attachment section in a first direction, the cartridge being removed from the cartridge attachment section in a second direction opposite to the first direction; and a consuming section including a recording head and configured to consume the consumable material stored in the cartridge completely attached to the cartridge attachment section, the cartridge comprising:

a board supporting portion;

a board supported by the board supporting portion, the board having a mount surface and a supported surface opposite to the mount surface, the mount surface facing in a third direction perpendicular to the first direction and the second direction, the supported surface facing in a fourth direction opposite to the third direction and supported by the board supporting portion, the board and a portion of the board supporting portion defining a moving trajectory during insertion and removal of the cartridge relative to the cartridge attachment section; and an electrical interface mounted on the mount surface of the board, the cartridge attachment section comprising:

a slider configured to contact at least one of the board and the board supporting portion of the cartridge, the slider being movable between a first position and a second position and between a first posture and a second posture in accordance with insertion and removal of the cartridge relative to the cartridge attachment section, the second position being displaced in the third direction relative to the first position, the slider at the first position being in the first posture and the slider at the second position being in the second posture;

an electrical contact provided on the slider and configured to contact the electrical interface of the cartridge, the electrical contact being movable between a contact position and a non-contact position in accordance with the movement of the slider between the first posture and the second posture;

a first wall provided on the slider at a position offset in the first direction relative to the electrical contact, the first wall having a portion that overlaps the moving trajectory of the board and the portion of the board supporting portion during insertion and removal of the cartridge relative to the cartridge attachment section;

a second wall provided on the slider at a position offset in the second direction relative to the electrical contact; and a biasing member configured to apply a biasing force to the slider in the second direction, wherein:

when the slider is at the first position and in the first posture, the electrical contact is in the contact position and overlaps the electrical interface of the cartridge completely attached to the cartridge attachment section, the second wall having a portion overlapping the moving trajectory;

when the slider is in the second posture, the electrical contact is in the non-contact position displaced in the third direction relative to the contact position, the second wall being displaced in the third direction relative to the moving trajectory; and when the cartridge has been completely attached to the cartridge attachment section, the cartridge and the cartridge attachment section define a first space therebetween at a position offset in the first direction relative to the board and the portion of the board supporting portion, the first wall being received in the first space; and the cartridge and the cartridge attachment section define a second space therebetween at a position offset in the second direction relative to the board and the portion of the board supporting portion, the second wall of the slider at the first position and in the first posture being received in the second space.

2. The system according to claim 1, wherein the slider is further movable to an intermediate position between the first position and the second position, the slider being in the first posture while moving between the intermediate position and the first position, and wherein the cartridge attachment section further comprises a locking part configured to restrict the cartridge completely attached to the cartridge attachment section from moving in the second direction against the biasing force of the biasing member.

3. The system according to claim 1, wherein the slider comprises:

a third wall positioned offset in a fifth direction perpendicular to the first direction and the second direction and the third direction and the fourth direction relative to the electrical contact, the third wall having a portion that overlaps the board of the cartridge completely attached to the cartridge attachment section in the fifth direction; and a fourth wall positioned offset in a sixth direction opposite to the fifth direction relative to the electrical contact, the fourth wall having a portion that overlaps the board of the cartridge completely attached to the cartridge attachment section in the sixth direction;

wherein, when the cartridge has been completely attached to the cartridge attachment section, the cartridge and the cartridge attachment section define a third space therebetween at position offset in the fifth direction relative to the board, the third wall being received in the third space, and the cartridge and the cartridge attachment section define a fourth space therebetween at position offset in the sixth direction relative to the board, the fourth wall being received in the fourth space.

4. The system according to claim 1, wherein the board supporting portion comprises a contact end protruding further in the first direction relative to the board and configured to contact the first wall provided on the slider.

5. The system according to claim 1, wherein the cartridge attachment section further comprises:

a first guide part extending in the second direction and having one end facing in the second direction; and a second guide part extending from the one end of the first guide part and being inclined relative to the first guide part such that the second guide part extends diagonally in the third direction toward downstream in the second direction, wherein the slider comprises:

a first guided portion positioned offset in the first direction relative to the electrical contact; and a second guided portion positioned offset in the second direction relative to the electrical contact, wherein the first guided portion and the second guided portion are supported by the first guide part when the slider is in the first posture, and wherein the first guided portion is supported by the first guide part and the second guided portion is supported by the second guide part when the slider is in the second posture.

6. The system according to claim 1, wherein the board supporting portion has a contact surface facing in the fourth direction, wherein the cartridge attachment section further comprises a restricting portion configured to contact the contact surface of the board supporting portion of the cartridge completely attached to the cartridge attachment section for restricting the board supporting portion from being displaced in the fourth direction.

7. The system according to claim 6, wherein the restricting portion comprises a first restricting part and a second restricting part spaced apart from each other in a fifth direction and a sixth direction opposite to the fifth direction, the fifth direction being perpendicular to the first direction and the second direction and the third direction and the fourth direction, the first wall of the slider at the first position being positioned between the first restricting part and the second restricting part in the fifth direction and the sixth direction.

8. The system according to claim 7, wherein the restricting portion comprises a guide surface configured to contact the board supporting portion during insertion of the cartridge into the cartridge attachment section, the guide surface being inclined relative to the first restricting part and the second restricting part to extend diagonally in the third direction toward downstream in the first direction.

9. The system according to claim 1, wherein the board has an end surface facing in the first direction, wherein the board supporting portion comprises a positioning portion in contact with the end surface of the board at a prescribed position to perform positioning of the board relative to the board supporting portion in the first direction, and wherein the first wall is configured to contact at least one of the board and the board supporting portion at a position different from the prescribed position.

10. The system according to claim 1, wherein the cartridge further comprises an integrated circuit configured to store information on the consumable material, the system further comprising a controller configured to electrically access to the integrated circuit through the contact between the electrical contact and the electrical interface.

11. The system according to claim 1, wherein the third direction is a vertically upward direction and the fourth direction is a vertically downward direction.

* * * * *